US010308014B2

(12) United States Patent
Watanabe et al.

(10) Patent No.: US 10,308,014 B2
(45) Date of Patent: Jun. 4, 2019

(54) NON-TRANSITORY RECORDING MEDIUM, IMAGE FORMING DEVICE, AND IMAGE FORMING SYSTEM

(71) Applicants: Jun Watanabe, Tokyo (JP); Yasunari Harada, Kanagawa (JP); Hideaki Iijima, Kanagawa (JP); Hiroki Tanaka, Kanagawa (JP); Toshiaki Hosokawa, Shiga (JP); Shunsuke Shitaoka, Kanagawa (JP)

(72) Inventors: Jun Watanabe, Tokyo (JP); Yasunari Harada, Kanagawa (JP); Hideaki Iijima, Kanagawa (JP); Hiroki Tanaka, Kanagawa (JP); Toshiaki Hosokawa, Shiga (JP); Shunsuke Shitaoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/004,563

(22) Filed: Jun. 11, 2018

(65) Prior Publication Data

US 2018/0354257 A1 Dec. 13, 2018

(30) Foreign Application Priority Data

Jun. 13, 2017 (JP) ..... 2017-116159

(51) Int. Cl.

| | |
|---|---|
| ***B41J 2/045*** | (2006.01) |
| ***B41J 3/36*** | (2006.01) |
| ***B41J 3/46*** | (2006.01) |

(52) U.S. Cl.

CPC ..... *B41J 2/04505* (2013.01); *B41J 2/04586* (2013.01); *B41J 3/36* (2013.01); *B41J 3/46* (2013.01)

(58) Field of Classification Search

CPC ..... B41J 3/36; B41J 3/46; B41J 3/445; B41J 29/38; B41J 29/393

USPC ..... 347/5, 9, 14, 19, 109

See application file for complete search history.

(56) References Cited

U.S. PATENT DOCUMENTS

| | | | |
|---|---|---|---|
| 9,440,452 | B2 | 9/2016 | Harada et al. |
| 2002/0030830 | A1 | 3/2002 | Day et al. |
| 2007/0139507 | A1 | 6/2007 | Ahne et al. |
| 2011/0109678 | A1 | 5/2011 | Schwartz et al. |

FOREIGN PATENT DOCUMENTS

| | | |
|---|---|---|
| JP | H09-156162 | 6/1997 |
| JP | 2016-060103 | 4/2016 |
| JP | 2016-097660 | 5/2016 |

OTHER PUBLICATIONS

Extended European Search Report for 18176752.6 dated Nov. 2, 2018.

*Primary Examiner* — An H Do

(74) *Attorney, Agent, or Firm* — IPUSA, PLLC

(57) ABSTRACT

A computer program for an information processing device communicating with a droplet discharging device is provided. The droplet discharging device is configured to form rendering data on a printing medium by being moved by a user on the printing medium, and includes a position calculation unit for calculating a position of the droplet discharging device, and a droplet discharging unit for discharging a droplet in accordance with the rendering data and location information. The computer program is configured to cause the information processing device to function as a scanning direction output unit for outputting a scanning direction of the droplet discharging device.

15 Claims, 29 Drawing Sheets font size × num. of characters ≦ value of width setting field
→ Determine line feed is not required font size × num. of characters > value of width setting field
→ Determine line feed is required font size × num. of lines + (num. of lines −1) × line spacing
≦ value of height setting field
→Determine as printable font size × num. of lines + (num. of lines −1) × line spacing
> value of height setting field
→Determine as unprintable

NON-TRANSITORY RECORDING MEDIUM, IMAGE FORMING DEVICE, AND IMAGE FORMING SYSTEM

CROSS-REFERENCE TO RELATED APPLICATION

The present application claims priority under 35 U.S.C. § 119 to Japanese Patent Application No. 2017-116159, filed on Jun. 13, 2017, the contents of which are incorporated herein by reference in their entirety.

BACKGROUND OF THE INVENTION

1. Field of the Invention

The present disclosure relates to a non-transitory recording medium, a droplet discharging device, and a droplet discharging system.

2. Description of the Related Art

Because a small-sized information processing device such as a smartphone is widely used and laptop PCs have become compact, there is a growing need for performing printing operations with a printer device being portable. Also, with respect to a network service communicating with a backbone system, there is a need for a user visiting a customer site to print out contents entered to the backbone system instantly, in order to share the contents with the customer.

To meet such needs, a droplet discharging system is known, which is a printer downsized by eliminating a paper conveyance system from the printer (hereinafter referred to as a handheld printer (HHP)). When printing content such as an image, a user holds the HHP and moves the HHP on a surface of paper such as a notebook (causes the HHP to scan the paper). The HHP detects a current location on the paper, and in accordance with the location, the HHP discharges ink for forming the image.

When using such an HHP, a case may happen in which a user desires to confirm a position where the HHP is currently printing (hereinafter, the position may be referred to as a "printing position"). To meet the requirement, a printing device is proposed, in which a shape of a printer head is improved (see Patent Document 1, for example). In a printing device disclosed in Patent Document 1, an inkjet head is configured such that a user can see a printing position and vicinity of the printing position.

However, regarding the HHP in the related art, it is difficult for a user to understand in which direction the HHP should be moved. Because a surface of a printing medium such as paper of a notebook is two-dimensional space, a user can cause the HHP to scan the printing medium in an arbitrary direction such as a vertical direction or a horizontal direction. However, since the HHP is to form an image in a region having a certain size determined by rendering data (data representing the image) while an initial position of the HHP is regarded as an origin of the region, if a user does not move the HHP in the region, the HHP cannot form the image. If a user were to move the HHP in an arbitrary direction, the HHP might be occasionally moved to the region where the image is to be formed. However, in such a method of moving the HHP, position detection errors will be accumulated, which results in quality degradation of an image formed on a printing medium.

[Patent Document 1] Japanese Unexamined Patent Application Publication No. H09-156162

SUMMARY OF THE INVENTION

According to one aspect of the present disclosure, a computer program for an information processing device communicating with a droplet discharging device is provided. The droplet discharging device is configured to form rendering data on a printing medium by being moved by a user on the printing medium, and includes a position calculation unit for calculating a position of the droplet discharging device, and a droplet discharging unit for discharging a droplet in accordance with the rendering data and location information. The computer program is configured to cause the information processing device to function as a scanning direction output unit for outputting a scanning direction of the droplet discharging device.

DESCRIPTION OF THE EMBODIMENTS

In the following, as an embodiment of the present disclosure, a droplet discharging device, a display method of an image data output device 11, and a droplet discharging system including the droplet discharging device and a program executed by the image data output device 11, will be described with reference to the drawings.

<Outline of Displaying Scanning Direction>

Figure 1:
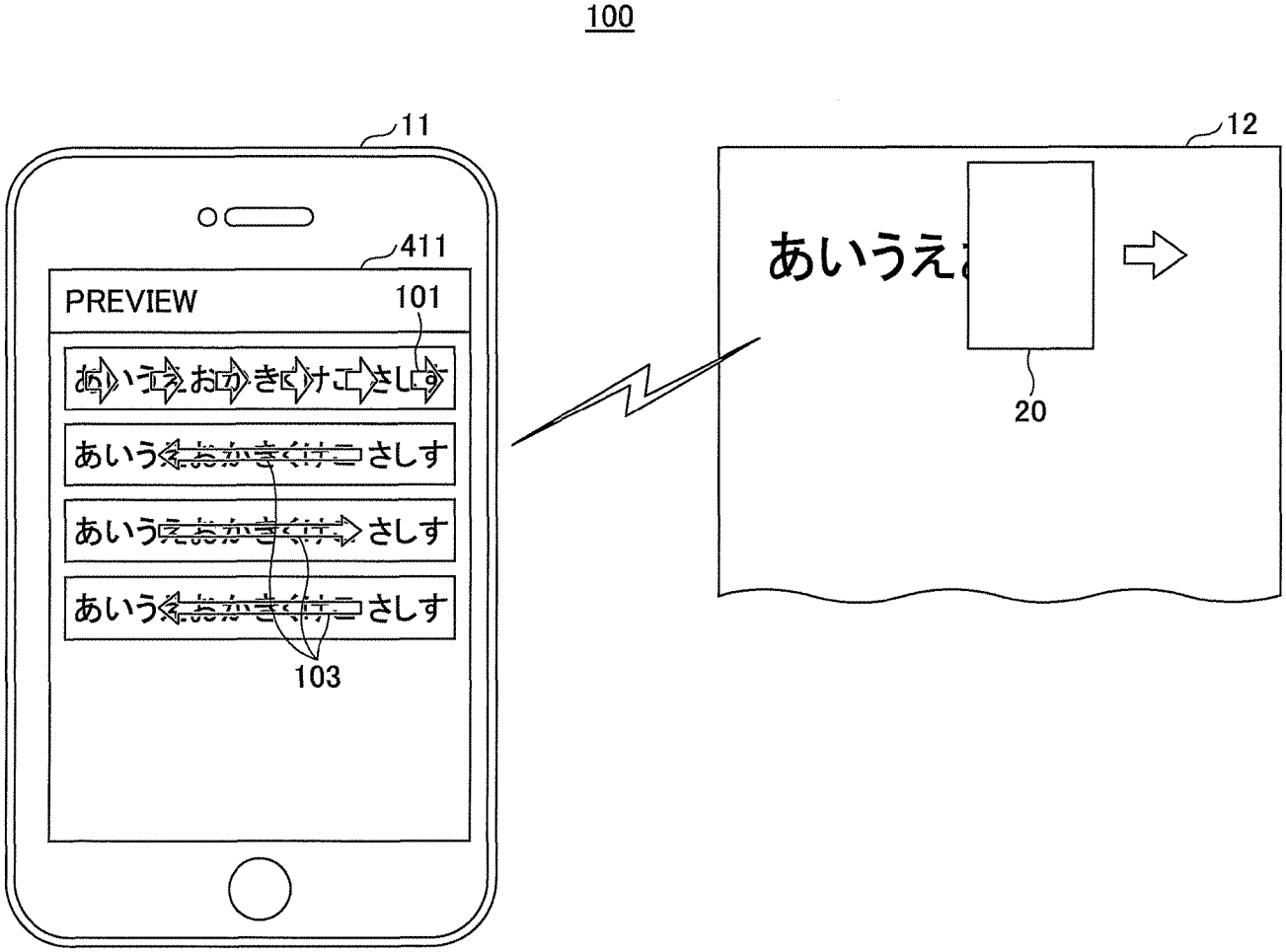
FIG. 1 is an example of a diagram illustrating an outline of a scanning direction displayed by an image data output device according to a present embodiment.

FIG. 1 is an example of a diagram illustrating an outline of a scanning direction displayed by the image data output device 11 according to the present embodiment. The image data output device 11 communicates with a handheld printer (hereinafter referred to as an "HHP") 20 wirelessly, to transmit image data and scanning information to the HHP 20. A user places the HHP 20 on a certain location (such as an upper-left) of a printing medium 12.

When a scan is ready, the image data output device 11 displays, on a preview screen 411 of the image data, a direction (scanning direction) in which the user should move the HHP 20 in order to form the image data. In FIG. 1, the scanning direction is represented as an arrow 101 (a first arrow). Accordingly, the user can move the HHP 20 toward an appropriate direction in accordance with the scanning direction displayed on the preview screen 411.

<Definitions of Terms>

Rendering data (or "rendering target data") is data that can be formed into a visibly recognizable state by discharging droplets. An example of the rendering data includes image data. However, the rendering data is not necessarily data recognized as an image. Other data such as a design drawing may be the rendering data.

A scanning direction represents a direction in which a user moves the HHP 20 on a printing medium 12. In the present embodiment, the scanning direction does not include an angle. However, an angle may be displayed in addition to the scanning direction. The scanning direction that is mainly used in the present embodiment is a horizontal direction and a vertical direction, but the scanning direction may be an oblique direction.

Note that an "output" means not only displaying but also sound output.

<Image Forming by HHP>

Figure 2:
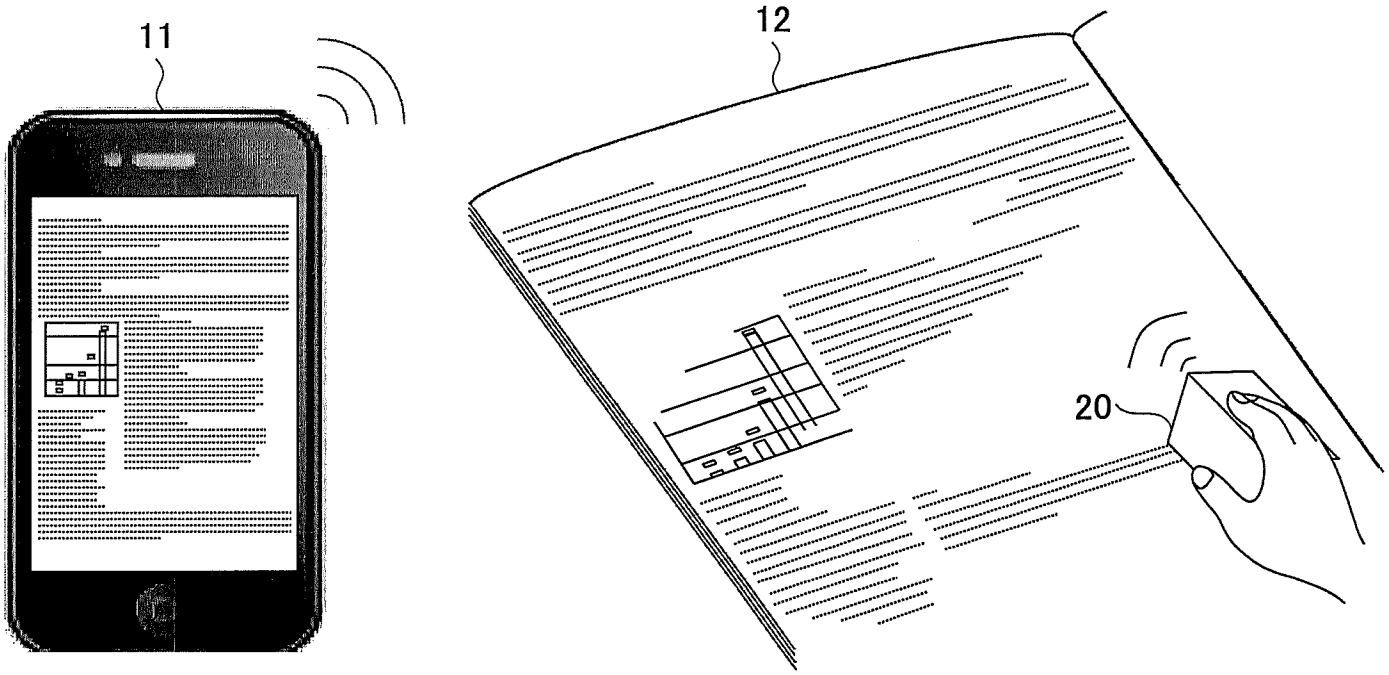
FIG. 2 is an example of a schematic diagram illustrating a method of forming an image by an HHP.

FIG. 2 is a schematic diagram illustrating a method of forming an image by the HHP 20. For example, image data and scanning information are transmitted from the image data output device 11 to the HHP 20. A set of the HHP 20 and the image data output device 11, or a set the HHP 20 and a program executed in the image data output device 11 is referred to as a droplet discharging system. A user holds the HHP 20, and moves the HHP 20 on a printing medium 12 (such as fixed size paper or a notebook) by freehand, such that the HHP 20 does not depart from the printing medium 12.

The image data output device 11 may be an information processing device having a function to perform wireless communication or wired communication with the HHP 20. An example of the image data output device 11 is a smartphone, a tablet terminal, a PC (Personal Computer), a PDA (Personal Digital Assistant), a cellular phone, a handheld terminal, a wearable PC (such as a watch-type device or a sunglasses-type device), a handheld game console, a car navigation device, a digital camera, a projector, a terminal for videoconferencing, and a drone.

As will be described below, the HHP 20 detects its position by a navigation sensor and a gyro sensor. When the HHP 20 moves to a target position of discharging (target discharging location), the HHP 20 discharges ink of a predetermined color to be discharged at the position. Regarding locations in which ink has already been discharged, as the locations will not be a target of discharging ink (the locations are masked), the user can form an image by freely moving the HHP 20 on the printing medium 12.

A reason why the HHP 20 should be moved such that the HHP 20 does not depart from the printing medium 12 is that the navigation sensor detects an amount of movement by using light reflected from the printing medium 12. If the HHP 20 departs from the printing medium 12, the navigation sensor cannot detect reflected light, and thus an amount of movement cannot be detected. A certain size of image that can be formed in a single operation, such as an image having N lines, is formed based on a certain initial position. If the HHP 20 fails to detect a current position of the HHP 20 while forming the certain size of image, the user instructs the image data output device 11 to cancel or retry the forming.

Since the HHP 20 forms an image by discharging ink on the printing medium 12, the HHP 20 can be referred to as an inkjet printer. Fluid to be discharged from the HHP 20 is not required to be ink, and may become a liquid state at a time of discharge. Hence, the HHP 20 may be referred to as a droplet discharging device. Alternatively, since an image is formed, the HHP 20 may be referred to as an image forming device or a printing device. Also, the HHP 20 may be referred to as an image processing device since the HHP 20 processes an image. Further, since the HHP 20 can be carried by a user with his/her hand, the HHP 20 may be referred to as an HMP (Handy Mobile Printer) 20.

The printing medium 12 may include a flat plane on a part of its surface. The flat plane may be a curved surface. An example of the printing medium 12 includes paper or a notebook. Further, the printing medium 12 is not required to be a sheet-like object. That is, the HHP 20 can form an image on a wall or a ceiling. For example, the HHP 20 can print on a surface of a corrugated cardboard, such as a side surface, a bottom surface, or an upper surface. Further, the HHP 20 can print on a solid object fixed on a ground or a facility.

<Configuration Example>

<<HHP>>

Figure 3:
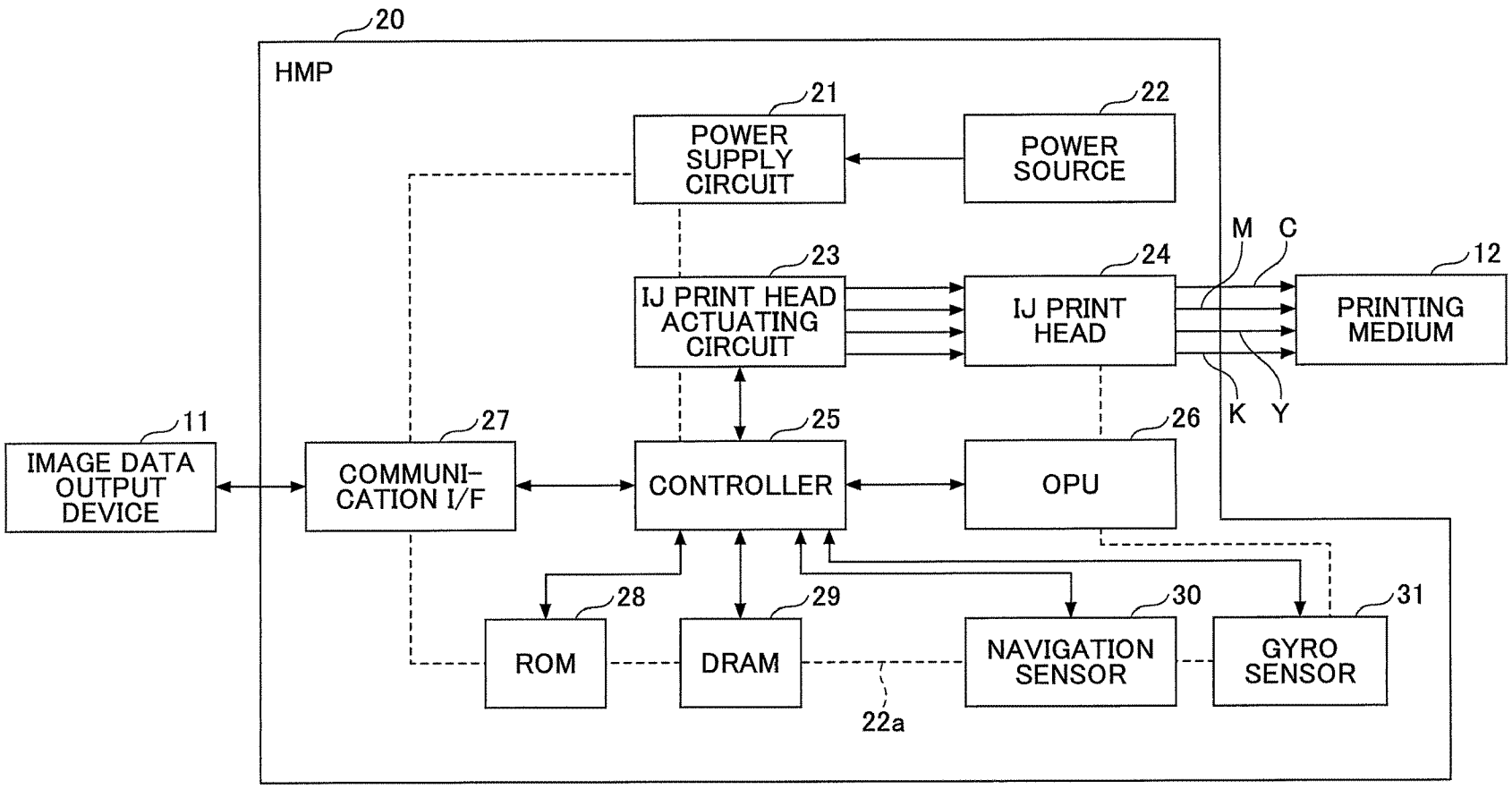
FIG. 3 is a diagram illustrating an example of a hardware configuration of the HHP.

FIG. 3 is a diagram illustrating an example of a hardware configuration of the HHP 20. An overall operation of the HHP 20 is controlled by a controller 25. A communication I/F 27, an IJ print head actuating circuit 23, an OPU 26, a ROM 28, a DRAM 29, a navigation sensor 30, and a gyro sensor 31 are electrically connected to the controller 25. As the HHP 20 is actuated by electric power, the HHP 20 includes a power source 22 and a power supply circuit 21. Electric power that is output from the power supply circuit 21 is supplied to the communication I/F 27, the IJ print head actuating circuit 23, the OPU 26, the ROM 28, the DRAM 29, an IJ print head 24, the controller 25, the navigation sensor 30, and the gyro sensor 31, through a wire or the like illustrated as a dotted line 22*a*.

A battery is mainly used as the power source 22. The battery to be used may be a commercially available dry cell, a commercially available rechargeable battery, or a dedicated rechargeable battery. In addition, a solar cell, a commercial power supply (AC power source), or a fuel cell may be used as the power source 22. The power supply circuit 21 distributes electric power supplied from the power source 22 to various components of the HHP 20. The power supply circuit 21 also increases or decreases a voltage supplied from the power source 22 such that a voltage supplied to each of the components becomes appropriate. Further, in a case in which the power source 22 is a rechargeable battery, when the power supply circuit 21 detects that an AC power source is connected, the power supply circuit 21 connects the AC power source with a charging circuit of the battery to charge the battery. The communication I/F 27 receives image data or the like from the image data output device 11 such as a smartphone or a PC (Personal Computer). The communication I/F 27 is a communication device in compliance with a certain communication standard such as wireless LAN, Bluetooth (registered trademark), NFC (Near Field Communication), infrared radiation, 3G (cellular phone), or LTE (Long Term Evolution). Alternatively, the communication I/F 27 may be a communication device supporting wired communication such as a wired LAN or a USB.

The ROM 28 stores firmware for controlling hardware of the HHP 20, actuation waveform data for the IJ print head 24 (data defining voltage patterns for discharging droplets), initial configuration data of the HHP 20, and the like.

The DRAM 29 is used for storing image data received by the communication I/F 27, or storing firmware loaded from the ROM 28. That is, the DRAM 29 is used as a work area for a CPU 33 executing firmware.

The navigation sensor 30 is a sensor for detecting an amount of movement of the HHP 20 per predetermined cycle time. The navigation sensor 30 includes, for example, a light source such as a light-emitting diode (LED) or a laser, and an imaging sensor for imaging the printing medium 12. When the HHP 20 is moved on the printing medium 12, minute edges on the printing medium 12 are detected one by one. By calculating distances between the edges, an amount of movement of the HHP 20 is obtained. In the present embodiment, only one navigation sensor 30 is provided on a bottom surface of the HHP 20. However, two navigation sensors 30 may be provided. As the gyro sensor 31 is provided in the HHP 20, more than one navigation sensor 30 is not necessary. Further, a multi-axis accelerometer may be used as a navigation sensor 30, and the HHP 20 may detect an amount of movement only by the accelerometer.

The gyro sensor 31 is a sensor for detecting an angular velocity of the HHP 20 when the HHP 20 rotates around an axis perpendicular to the printing medium 12. The controller 25 calculates an angle of the HHP 20 by integrating the angular velocity. The "angle" is a rotating angle of the HHP 20 around an axis perpendicular to the printing medium 12. An example of an origin of the rotating angle is a longitudinal direction of the HHP 20 when printing is started.

The OPU (Operation panel Unit) 26 includes (but is not limited to) an LED for displaying a status of the HHP 20, a switch used by a user to instruct the HHP 20 to form an image, and the like. The OPU 26 may also include a liquid crystal display or a touch panel. Further, the OPU 26 may include a voice input function.

The IJ print head actuating circuit 23 generates an actuation waveform (voltage) for actuating the IJ print head 24, using the above mentioned actuation waveform data. The IJ print head actuating circuit 23 can generate an actuation waveform in accordance with a size of an ink droplet or the like.

The IJ print head 24 is a head for discharging ink. In the drawing, an example in which inks of four types of colors (CMYK) can be discharged is illustrated. However, the IJ print head 24 may discharge ink of single color, or may discharge inks of more than four colors. For each color, nozzles (discharging unit) 61 for discharging ink are arranged in a row (may be more than one row). Regarding ink discharging technique, any types of technique, such as piezoelectric technique or thermal technique, may be used. The IJ print head 24 is a functional component for discharging or spraying liquid from the nozzles 61. Liquid to be discharged is not limited to a specific one as long as the liquid has viscosity or surface tension enough to be discharged from the IJ print head 24, with viscosity preferably being not larger than 30 mPa·s under normal temperature and normal pressure, or under heating or cooling. More specifically, example of the liquid include a solvent such as water or organic solvent, colorant such as dye or pigment, a polymerizable compound, resin, functional imparting material such as a surfactant, a biocompatible material such as DNA, an amino acid, a protein, or calcium, and an edible material such as natural dye, suspension, and emulsion. The above liquids can be used as, for example, ink for inkjet printer, surface treatment liquid, a component for an electronic element or a light emitting element, a liquid for forming a resist pattern for an electronic circuit, and a liquid for modeling a three-dimensional object.

The controller 25 includes the CPU 33 and performs an overall control of the HHP 20. The controller 25 performs, based on an amount of movement detected by the navigation sensor 30 and an angular velocity detected by the gyro sensor 31, a determination of a position of each nozzle of the IJ print head 24, a determination of an image to be formed in response to the position of the nozzle, and a nozzle discharging appropriateness determination to be described below. Details of the controller 25 will be described below.

Figure 4:
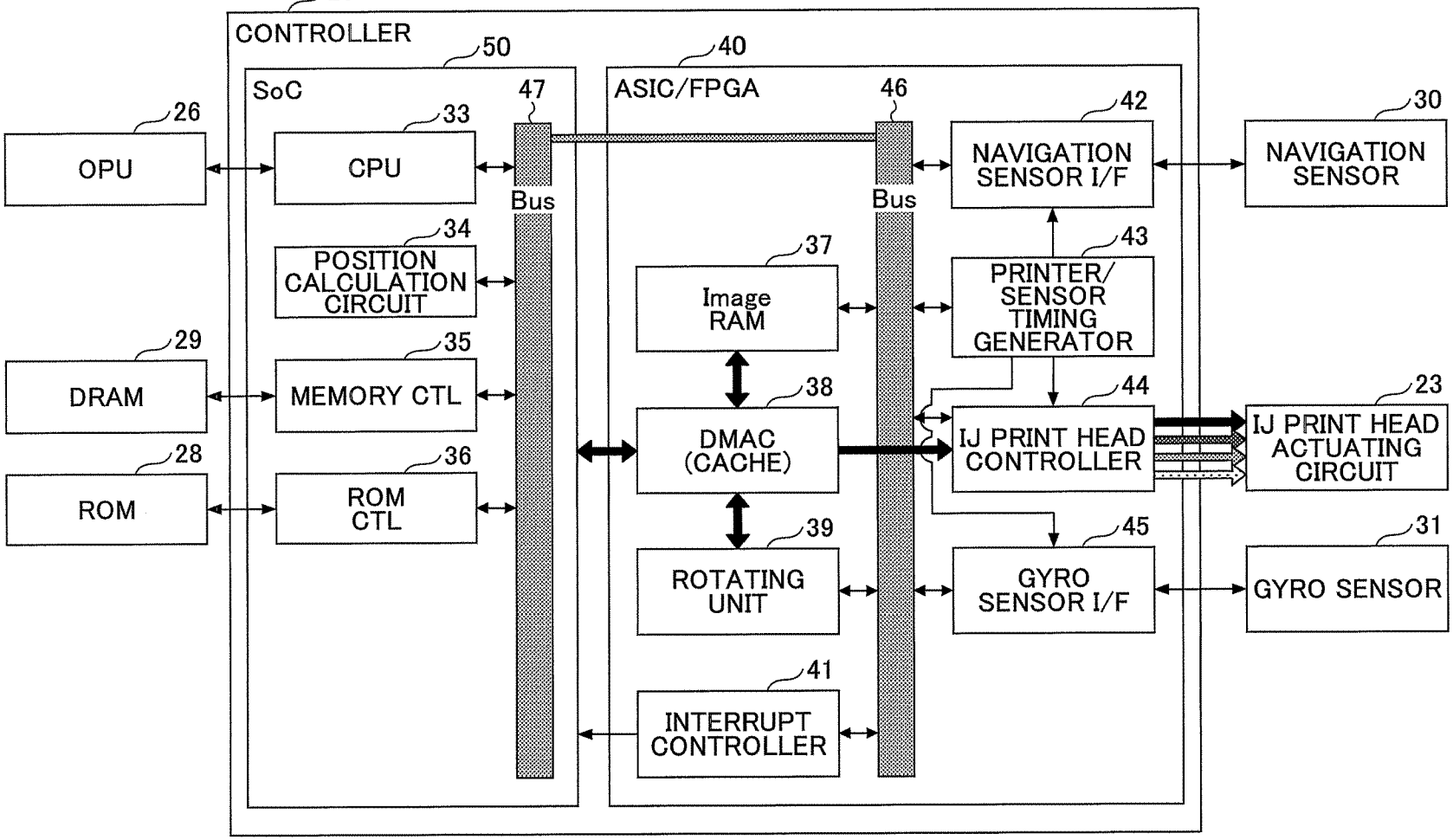
FIG. 4 is a diagram illustrating an example of a configuration of a controller.

FIG. 4 is a diagram illustrating an example of a configuration of the controller 25. The controller 25 includes an SoC 50 and an ASIC/FPGA 40. The SoC 50 and the ASIC/FPGA 40 communicate with each other via buses 46 and 47. With respect to the ASIC/FPGA 40, notation of "ASIC/FPGA" represents that the ASIC/FPGA 40 may be implemented by any of ASIC and FPGA, but the ASIC/FPGA 40 may be implemented by other implementation techniques. Also, the SoC 50 and the ASIC/FPGA 40 are not required to be separate chips from each other. That is, the controller 25 may be implemented by a single chip or circuit board. Alternatively, the controller 25 may be implemented by more than two chips or circuit boards.

The SoC 50 includes components such as the CPU 33, a position calculation circuit 34, a memory controller (memory CTL) 35, and a ROM controller (ROM CTL) 36, and each of the components is interconnected via the bus 47.

Note that components included in the SoC 50 are not limited to those mentioned above. The ASIC/FPGA 40 includes components such as an image RAM 37, a DMAC 38, a rotating unit 39, an interrupt controller 41, a navigation sensor I/F 42, a printer/sensor timing generator 43, an IJ print head controller 44, and a gyro sensor I/F 45, and each of the components is interconnected via the bus 46. Note that components included in the ASIC/FPGA 40 are not limited to those mentioned above.

The CPU 33 controls the position calculation circuit 34, the memory CTL 35, and the ROM CTL 36 that are included in the SoC 50, by executing firmware (program) loaded from the ROM 28 to the DRAM 29. The CPU 33 also controls the components in the ASIC/FPGA 40 such as the image RAM 37, the DMAC 38, the rotating unit 39, the interrupt controller 41, the navigation sensor I/F 42, the printer/sensor timing generator 43, the IJ print head controller 44, and the gyro sensor I/F 45.

The position calculation circuit 34 calculates a position (coordinate information) of the HHP 20, based on an amount of movement per sampling frequency detected by the navigation sensor 30 and an angular velocity per sampling frequency detected by the gyro sensor 31. Technically, what must be obtained as a position of the HHP 20 is a position of the nozzles 61. However, if a location of the navigation sensor 30 in the HHP 20 is known, a position of the nozzles 61 can be calculated from the position of the navigation sensor 30 (coordinate information detected by the navigation sensor 30). In the present embodiment, unless otherwise stated, a position of the HHP 20 means a position of the navigation sensor 30. Note that functions of the position calculation circuit 34 may be embodied by the CPU 33 executing software (program).

The position of the navigation sensor 30 is calculated while a certain point (an initial position of the HHP 20 when image forming begins) is regarded as an origin. Further, the position calculation circuit 34 estimates a direction of movement and acceleration based on a difference between the most recent position and a previous position, and estimates a position of the navigation sensor 30 when discharging is performed the next time. By performing such estimation, a delay of position detection in response to movement of the HHP 20 is reduced, and ink can be discharged at an appropriate timing.

The memory CTL 35 is an interface with the DRAM 29, and requests data of the DRAM 29. The memory CTL 35 also transmits obtained firmware to the CPU 33, or transmits obtained image data to the ASIC/FPGA 40.

The ROM CTL 36 is an interface with the ROM 28, and requests data of the ROM 28. The ROM CTL 36 also transmits the obtained data to the CPU 33 or the ASIC/FPGA 40.

The rotating unit 39 rotates image data obtained by the DMAC 38 (generates a rotated image of an image represented by image data obtained by the DMAC 38), based on a position of a head for discharging ink, a position of a nozzle in the head, or a degree of lean of the head caused by an installation error. The DMAC 38 outputs the rotated image data to the IJ print head controller 44. The image RAM 37 temporarily stores image data obtained by the DMAC 38. That is, the image RAM 37 buffers a certain amount of image data, and the buffered data is read out in accordance with a position of the HHP 20.

The IJ print head controller 44 converts image data (such as Tiff format data) into a group of dots expressing an image by a size and a density of the dots, by applying a process such as dithering. By the conversion, image data is changed into data consisting of discharging locations and sizes of dots. The IJ print head controller 44 outputs a control signal in accordance with a size of a dot to the IJ print head actuating circuit 23.

The IJ print head actuating circuit 23 generates an actuation waveform (voltage), by using actuation waveform data corresponding to the above mentioned control signal.

The navigation sensor I/F 42 communicates with the navigation sensor 30, and receives information about movement amounts $\Delta X'$, $\Delta Y'$ (which will be described below) from the navigation sensor 30, and stores these values into an internal register of the navigation sensor I/F 42.

The printer/sensor timing generator 43 sends timing for acquiring information, to the navigation sensor I/F 42 and the gyro sensor I/F 45, and sends timing for actuation to the IJ print head controller 44. A period for acquiring information is longer than a period for discharging ink. The IJ print head controller 44 performs a nozzle discharging appropriateness determination to determine if a nozzle 61 is located at a target discharging position in which ink should be discharged. If the nozzle 61 is located at a target discharging position, it is determined that ink should be discharged, and if the nozzle 61 is not located at a target discharging position, it is determined that ink should not be discharged.

The gyro sensor I/F 45 acquires an angular velocity detected by the gyro sensor 31 at a timing sent from the printer/sensor timing generator 43, and stores the acquired value into a register.

When the interrupt controller 41 detects that the navigation sensor I/F 42 terminates a communication with the navigation sensor 30, to notify the SoC 50 that the communication has terminated, the interrupt controller 41 outputs an interrupt signal to the SoC 50. In response to the interrupt, the CPU 33 acquires the above mentioned $\Delta X'$ and $\Delta Y'$ retained in the internal register of the navigation sensor I/F 42. In addition to the above function, the interrupt controller 41 also includes a function to send a notification of a status such as an error. With respect to the gyro sensor I/F 45, a similar operation is performed by the interrupt controller 41. That is, the interrupt controller 41 outputs an interrupt signal to notify the SoC 50 that the gyro sensor I/F 45 has terminated a communication with the gyro sensor 31.

<<Image Data Output Device 11>>

Figure 5:
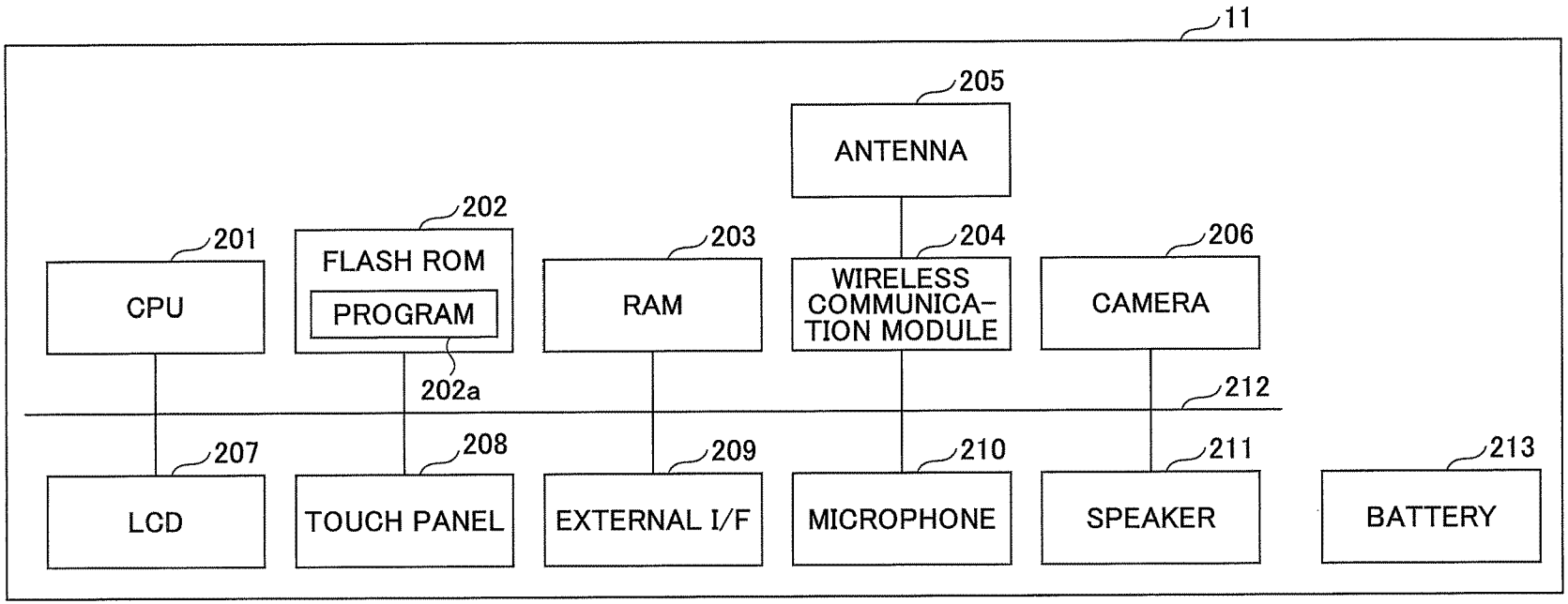
FIG. 5 is a diagram illustrating an example of a hardware configuration of the image data output device.

FIG. 5 is a diagram illustrating an example of a hardware configuration of the image data output device 11. The image data output device 11 illustrated in FIG. 5 includes hardware components such as a CPU 201, a flash ROM 202, a RAM 203, a wireless communication module 204, an antenna 205, a camera 206, an LCD 207, a touch panel 208, an external I/F 209, a microphone 210, and a speaker 211. The above hardware components are interconnected via a bus 212, and are capable of data communication with each other. The image data output device 11 also includes a battery 213, and electric power is supplied to each of the above hardware components from the battery 213.

The CPU 201 performs an overall control of the image data output device 11, by performing an operation of various data in accordance with a program stored in the flash ROM 202. The flash ROM 202 stores a program **202*a* for the overall control of the image data output device 11**, and also acts as storage for storing various data.

The RAM 203 is used as a work memory for the CPU 201. The program **202*a* stored in the flash ROM 202 is loaded into the RAM 203, and is executed by the CPU 201**.

The wireless communication module 204 communicates with the HHP 20 by means of communication media or protocols such as Bluetooth (registered trademark), wireless LAN, NFC, or infrared radiation. The wireless communication module 204 may be configured to perform voice communication or data communication using a cellular network such as 3G or LTE.

The camera 206 performs A/D conversion (analog to digital conversion) of image signals output from an image sensor. The LCD 207 displays an icon for operating the image data output device 11, and displays various data. The touch panel 208 coincides with the LCD 207, and a surface of the touch panel 208 is closely adhered to a surface of the LCD 207. The touch panel 208 detects a location on which a user touches by finger.

The external I/F 209 is an interface for connecting with peripheral devices. An example of the external I/F 209 is a USB interface. The microphone 210 performs A/D conversion of input audio signals. The speaker 211 outputs audible signals by converting (performing D/A conversion) audio data.

<Function of Image Data Output Device 11>

Figure 6:
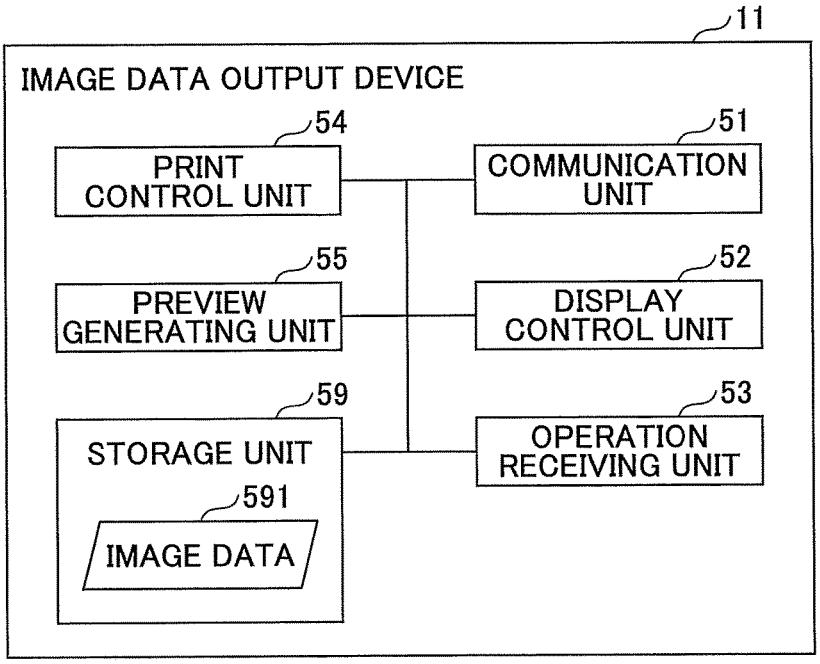
FIG. 6 is a diagram illustrating functional blocks of the image data output device.

FIG. 6 is a diagram illustrating functional blocks of the image data output device 11. The image data output device 11 includes the following functional blocks: a communication unit 51, a display control unit 52, an operation receiving unit 53, a print control unit 54, a preview generating unit 55, and a storage unit 59. These functional blocks of the image data output device 11 are embodied by the CPU 201 executing the program 202*a* and coordinating with hardware components as illustrated in FIG. 5. The program 202*a* may be supplied from a server for delivering programs, or may be supplied by distributing removable storage media storing the program 202*a*, such as a USB memory or an optical storage medium.

The communication unit 51 transmits and receives various information to (and from) the HHP 20. In the present embodiment, image data and scanning information is transmitted to the HHP 20, and an indication of a start or end of scan is received from the HHP 20. The communication unit 51 is embodied by the CPU 201 executing the program 202*a* loaded from the flash ROM 202 into the RAM 203 and controlling the wireless communication module 204.

The display control unit 52 performs various controls related to contents displayed on the LCD 207. In the present embodiment, a direction to which the user should move the HHP 20 is displayed on the preview screen 411. The display control unit 52 is embodied by the CPU 201 executing the program 202*a* loaded from the flash ROM 202 into the RAM 203 and controlling the LCD 207.

The operation receiving unit 53 receives various operations for the image data output device 11 from a user. The operation receiving unit 53 is embodied by the CPU 201 executing the program 202*a* loaded from the flash ROM 202 into the RAM 203 and controlling the touch panel 208.

The print control unit 54 performs controls related to printing of image data. That is, the print control unit 54 performs communication with HHP 20, generation of image data, and control related to interruption or restart of printing. The print control unit 54 is embodied by the CPU 201 executing the program 202*a* loaded from the flash ROM 202 into the RAM 203.

The preview generating unit 55 generates a preview screen and generates a scanning direction. A display process itself is performed by the display control unit 52, and the preview generating unit 55 determines information of an arrow indicating a scanning direction, such as a location, a direction, a shape, or a color. The preview generating unit 55 is embodied by the CPU 201 executing the program 202*a* loaded from the flash ROM 202 into the RAM 203. The storage unit 59 stores image data 591.

A file format of the image data 591 is not limited to a specific format, and examples of the file format of the image data 591 include TIFF, JPEG, and BMP. Alternatively, the image data 591 may be print data described in a page description language (PDL) such as PostScript or PDF. The image data 591 is, for example, generated by converting one or more lines of text data entered to the image data output device 11 by a user. Alternatively, the image data 591 may be downloaded from a cloud server. In addition, the text data may be generated by means of voice recognition function. The storage unit 59 is embodied by either one of the flash ROM 202 or the RAM 203.

<Navigation Sensor>

Figure 7:
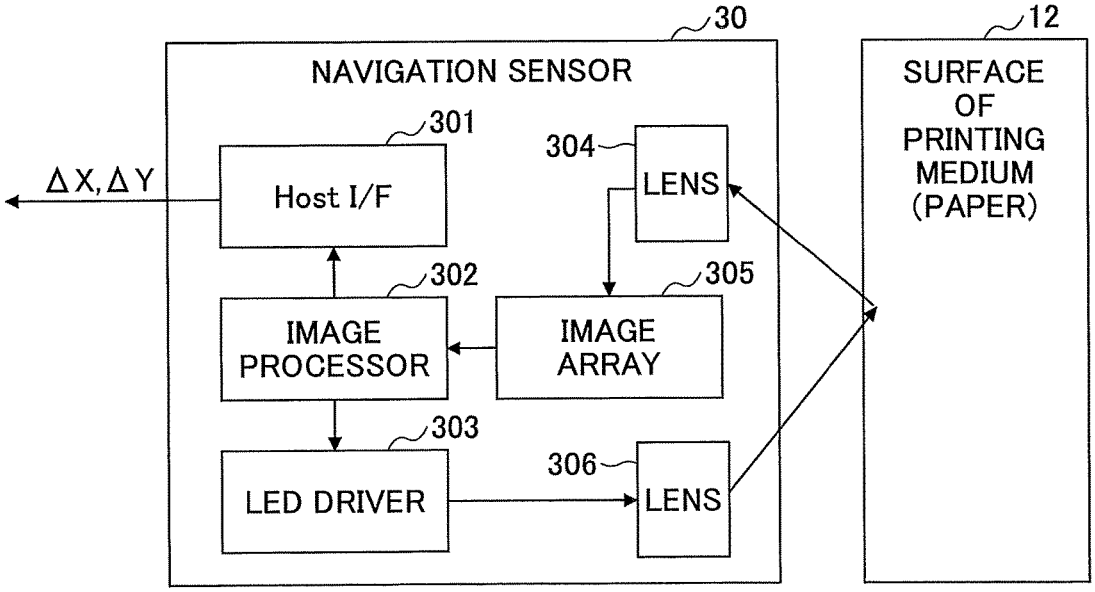
FIG. 7 is a diagram illustrating an example of a hardware configuration of a navigation sensor.

FIG. 7 is a diagram illustrating an example of a hardware configuration of the navigation sensor. The navigation sensor 30 includes a host I/F 301, an image processor 302, an LED driver 303, two lenses 304 and 306, and an image array 305. The LED driver 303 is configured such that an LED and a control circuit are integrated, and emits LED light in accordance with an instruction from the image processor 302. The image array 305 receives LED light reflected by the printing medium 12 via the lens 304. The two lenses 304 and 306 are disposed in the navigation sensor 30 so as to focus on a surface of the printing medium 12 optically.

The image array 305 includes an element such as a photodiode sensitive in a wavelength of LED light, and generates image data from the received LED light. The image processor 302 acquires the image data, and calculates an amount of movement of the navigation sensor 30 (the above $\Delta X'$, $\Delta Y'$) using the image data. The image processor 302 outputs the calculated amount of movement to the controller 25 via the host I/F 301.

A light-emitting diode (LED) used as a light source is useful in a case in which a printing medium 12 having a rough surface, such as paper, is used. Because a shadow is generated from a rough surface of a printing medium 12, an amount of movement distance in an X-direction and a Y-direction can be calculated precisely, by using the shadow as a characterizing portion. Conversely, in a case in which a printing medium 12 having a smooth surface is used, or in which a transparent printing medium 12 is used, a semiconductor laser (LD), which emits laser light, can be used as a light source. Because a semiconductor laser can generate a pattern, such as a stripe pattern, on a printing medium 12 as a characterizing portion, an amount of movement distance can be calculated precisely based on the pattern.

Figure 8:
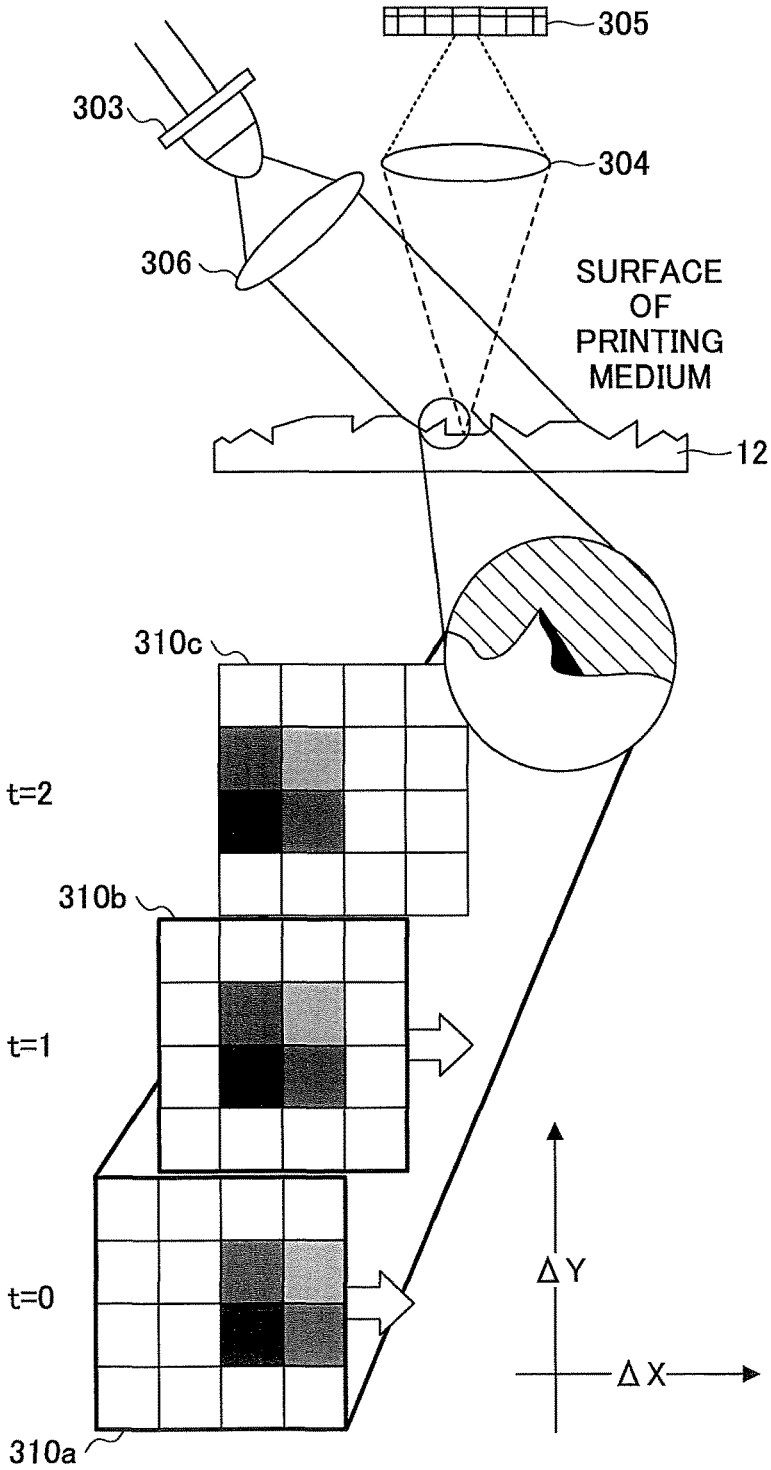
FIG. 8 is a diagram illustrating a detecting method of an amount of movement using the navigation sensor.

Next, an operation of the navigation sensor 30 will be described with reference to FIG. 8. FIG. 8 is a diagram illustrating a detecting method of an amount of movement using the navigation sensor 30. Light emitted by the LED driver 303 reaches a surface of the printing medium 12 via the lens 306. Because various shapes of projections and recesses are formed on the surface of the printing medium 12, as illustrated in FIG. 8, various shapes of shadows are generated when the surface is irradiated.

The image processor 302 receives reflected light via the lens 304 and the image array 305 at each predetermined sampling interval, and generates image data. In FIG. 8, examples of image data obtained at three different time points (sampling time) are illustrated. In the following description, image data obtained at time t=0, image data obtained at time t=1, and image data obtained at time t=2 are respectively referred to as "image data 310*a*", "image data 310*b*", and "image data 310*c*". Further, when image data 310*a*, image data 310*b*, and image data 310*c* are not required to be distinguished from each other, they are referred to as "image data 310". As illustrated in FIG. 8, the image processor 302 converts the image data 310 into a set of predetermined sized pixels. That is, the image data 310 is divided into multiple rectangular regions. Subsequently, the image processor 302 compares image data 310 obtained at most recent sampling time with image data 310 obtained at previous sampling time, to detect the number of rectangular regions (pixels) that the image data has moved and to determine the detected number as an amount of movement. Suppose a case in which the HHP 20 moves in ΔX direction (illustrated in FIG. 8). When comparing the image data 310*a* at time t=0 with the image data 310*b* at time t=1, a shape of an image placed at the right end of the image data 310*a* coincides with a shape of an image placed at the center of the image data 310*b*. Accordingly, the shape of the image moves in the −ΔX direction from time t=0 to time t=1, and it is found that the HHP 20 moves by one pixel in the ΔX direction. When comparing the image data 310*b* at time t=1 with the image data 310*c* at time t=2, a similar result can be obtained.

<Position of Nozzle in IJ Print Head>

Figure 9A:
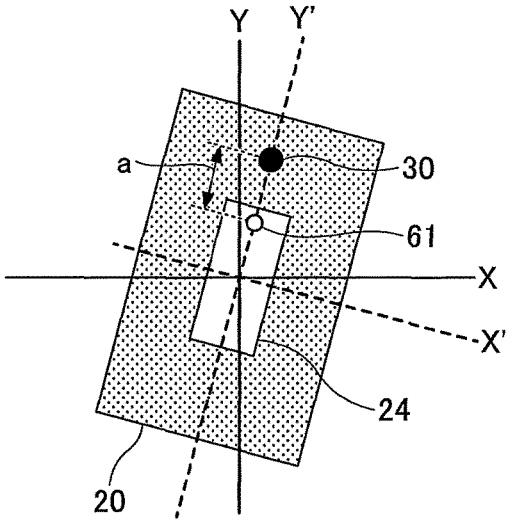
FIG. 9A is an example of a plan view of the HHP.
Figure 9B:
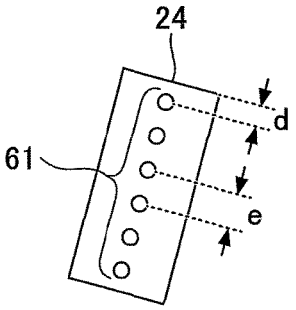
FIG. 9B is an example of a diagram illustrating only an IJ print head.

Next, positions of nozzles in the IJ print head 24 will be described with reference to FIG. 9A and FIG. 9B. FIG. 9A is an example of a plan view of the HHP 20. FIG. 9B is an example of a diagram illustrating only the IJ print head 24. A plane illustrated in FIGS. 9A and 9B faces the printing medium 12.

The HHP 20 according to the present embodiment includes one navigation sensor 30. A distance from the navigation sensor 30 to the IJ print head 24 is "a". The distance "a" may be zero (in a case in which the navigation sensor 30 is in contact with the IJ print head 24). In the present embodiment, as the HHP 20 includes only a single navigation sensor 30, the navigation sensor 30 may be disposed at any location around the IJ print head 24. Accordingly, the depicted location of the navigation sensor 30 is merely an example. However, a short distance between the navigation sensor 30 and the IJ print head 24 helps to configure a size of the bottom surface of the HHP 20 to be small.

As illustrated in FIG. 9B, a distance from the end of the IJ print head 24 to the closest nozzle 61 from the end of the IJ print head 24 is d, and a distance between adjacent nozzles is e. Values of a, d, and e are recorded in a storage medium such as the ROM 28.

By using the distances a, d, and e, the position calculation circuit 34 can calculate a position of the nozzle 61 after the position calculation circuit 34 calculates a position of the navigation sensor 30.

<Position of HHP with Respect to Printing Medium>

Figure 10A:
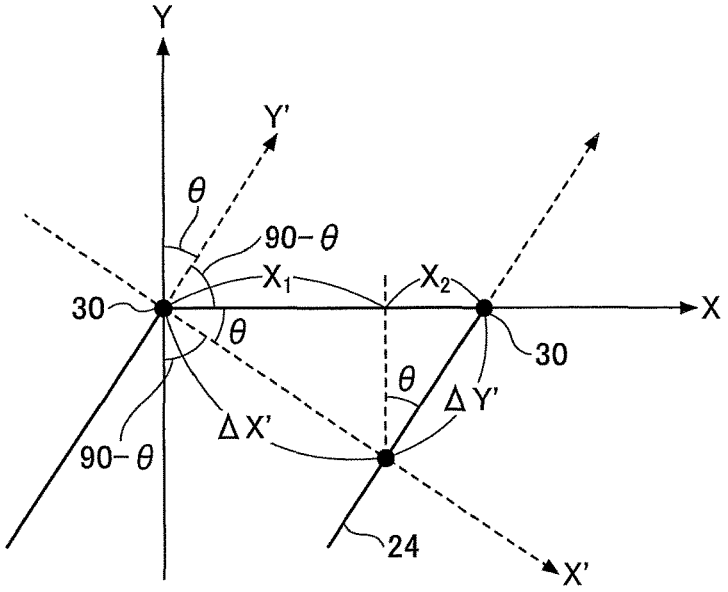
FIG. 10A and FIG. 10B are diagrams illustrating an example of a coordinate system of the HHP and a method for calculating a position of the HHP.
Figure 10B:
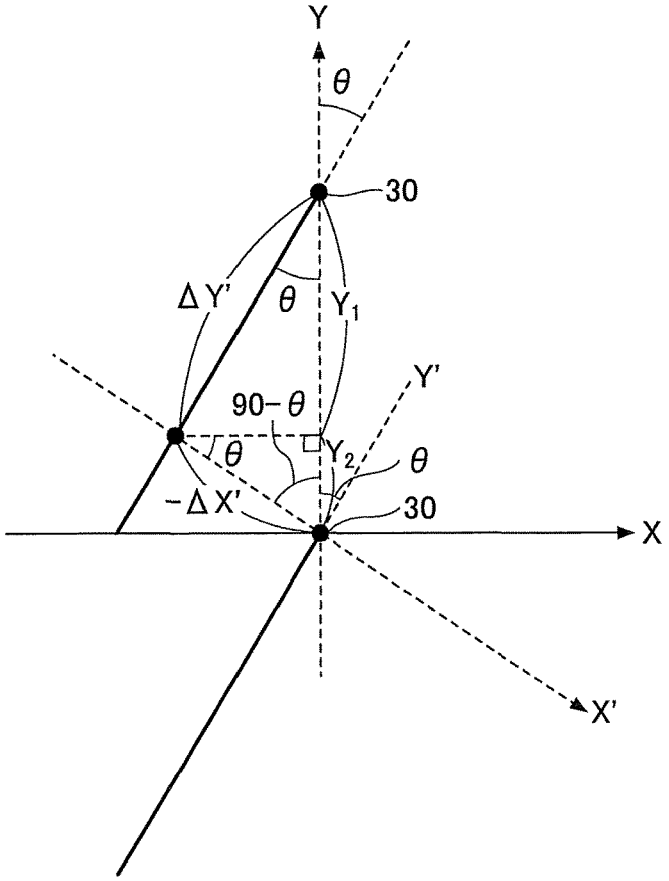

FIG. 10A and FIG. 10B are diagrams illustrating an example of a coordinate system of the HHP 20 and a method for calculating a position of the HHP 20. In the present embodiment, let a position of the navigation sensor 30 when printing starts be an origin of the coordinate system. Also, let a horizontal direction of the printing medium 12 be an X axis, and let a vertical direction of the printing medium 12 be a Y axis. In the following, coordinates that are defined in this coordinate system are referred to as printing medium coordinates. However, the navigation sensor 30 outputs amounts of movement in parallel with an X' axis and a Y' axis illustrated in FIG. 9A or 10A. That is, a line in which the nozzles 61 are aligned is defined as a Y' axis, a direction perpendicular to the Y' axis is defined as an X' axis, and the navigation sensor 30 outputs amounts of movement in the X' axis direction and the Y' axis direction.

In the following description, a case will be described, in which the HHP 20 is in a state rotated clockwise by θ with respect to the printing medium 12, as illustrated in FIG. 10A. As it is difficult for a user to move the HHP 20 without rotating, it is conceivable that θ will be not zero. If the HHP 20 does not rotate at all, X and Y are equal to X' and Y' respectively. However, when the HHP 20 is rotated by θ with respect to the printing medium 12, a position calculated based on outputs of the navigation sensor 30, under the premise that X and Y are respectively equal to X' and Y', will not be equal to an actual position of the HHP 20 with respect to the printing medium 12. Note that the HHP 20 is rotated clockwise when the rotating angle θ is positive, the HHP 20 is moved toward a right direction when X or X' is positive, and the HHP 20 is moved toward an upper direction when Y or Y' is positive.

FIG. 10A is a diagram illustrating an example of an X coordinate of the HHP 20. FIG. 10A illustrates a relation between the printing medium coordinates (X, Y) of the HHP 20 and amounts of movement (ΔX', ΔY') detected by the navigation sensor 30, when the HHP 20 having a rotating angle θ is moved toward only an X direction while maintaining the rotating angle θ. Note that, when two navigation sensors 30 are provided in the HHP 20, outputs of both of the navigation sensors 30 (amounts of movement) are the same because a relative location of each of the navigation sensors 30 is fixed. The X coordinate of the navigation sensor 30 is $X_1+X_2$, and $X_1+X_2$ can be calculated from ΔX', ΔY', and θ.

FIG. 10B illustrates a relation between the printing medium coordinates (X, Y) of the HHP 20 and amounts of movement (ΔX', ΔY') detected by the navigation sensor 30, when the HHP 20 having a rotating angle θ is moved toward only a Y direction while maintaining the rotating angle θ. The Y coordinate of the navigation sensor 30 is $Y_1+Y_2$, and $Y_1+Y_2$ can be calculated from −ΔX', ΔY', and θ.

Accordingly, when the HHP 20 is moved toward an X direction and a Y direction while maintaining the rotating angle θ, ΔX', ΔY' output by the navigation sensor 30 can be transformed into the printing medium coordinates (X, Y) in accordance with the following formulas.

$$X=\Delta X' \cos\theta+\Delta Y' \sin\theta \quad (1)$$

$$Y=-\Delta X' \sin\theta+\Delta Y' \cos\theta \quad (2)$$

<Rotating Angle>

Next, a method for calculating a rotating angle θ using an output of the gyro sensor 31 will be described. The output of the gyro sensor 31 is an angular velocity ω. As ω is equal to dθ/dt, if dt is assumed to be a sampling period, a variation of a rotating angle dθ (during the sampling period) can be expressed as the following.

$$d\theta=\omega\times dt$$

Accordingly, in a case in which the HHP 20 starts moving at time t=0 and a current time is t=N, a current rotating angle θ can be expressed as the following formula.

$$\theta=\sum_{t=0}^{N}\omega_t\times dt$$

Note that $\omega_t$ is an angular velocity at a sampling time t.

As described above, a rotating angle θ can be calculated by the gyro sensor 31. Further, as mentioned in the formulas (1) and (2), a position of the navigation sensor 30 can be calculated by using a rotating angle θ. If a position of the navigation sensor 30 is calculated, the position calculation circuit 34 can calculate a position of each of the nozzles 61 by using the values a, d, and e illustrated FIGS. 9A and 9B. Note that X in formula (1) and Y in formula (2) each represent a variation during a sampling period. Accordingly, by accumulating the variation during every sampling period, a current position can be calculated.

<Target Discharging Location>

Figure 11:
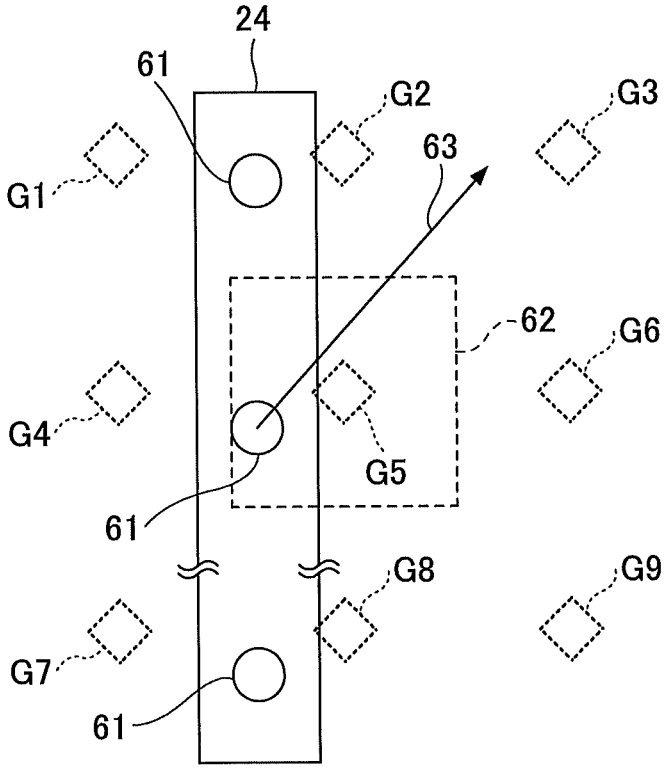
FIG. 11 is a diagram illustrating an example of a relation between a target discharging location and a position of a nozzle.

Next, a target discharging location will be described with reference to FIG. 11. FIG. 11 is a diagram illustrating an example of a relation between a target discharging location and a position of a nozzle 61. Target discharging locations G1 to G9 are targets of locations at which the HHP 20 shoots ink from the nozzle 61. The target discharging locations G1 to G9 can be calculated from an initial position of the HHP 20 and resolutions in an X-axis and a Y-axis direction (Xdpi, Ydpi).

For example, when a resolution is 300 dpi, target discharging locations are set at an interval of 0.084 [mm] in a longitudinal direction of the IJ print head 24 and its perpendicular direction, from an initial position of the HHP 20. If a target discharging location is where ink should be shot, the HHP 20 discharges ink.

However, in reality, it is rare that an event of a location of the nozzle 61 completely coinciding with a target discharging location occurs; thus, the HHP 20 is configured to allow a difference between a target discharging location and a current position of the nozzle 61 when the difference is within an acceptable error 62. If it is determined that the nozzle 61 is currently positioned within a range of the acceptable error 62 from a target discharging location, the HHP 20 discharges ink from the nozzle 61 (the determination whether to discharge ink or not is referred to as a "nozzle discharging appropriateness determination").

Further, the HHP 20 estimates a location of the nozzle 61 for the next ink discharge timing, by monitoring a moving direction and acceleration of the nozzle 61 as an arrow 63 (FIG. 11) indicates. Accordingly, the HHP 20 can prepare for discharging ink by comparing an estimated location with an area within a range of the acceptable error 62 from a target discharging location.

TABLE 1

| Target Discharging Location | | Ink Discharge 0: Not required | Discharged 0: Not yet |
|---|---|---|---|
| X | Y | 1: Required | 1: Discharged |
| 0.084 | 0.084 | 0 | 0 |
| 0.084 | 0.168 | 1 | 0 |
| 0.084 | 0.252 | 1 | 1 |
| . . . | . . . | . . . | . . . |

Table 1 is a discharge control table recording a necessity of discharging ink and information whether discharge is completed or not, for each target discharging location. In the discharge control table, the necessity of discharging ink as determined based on image data is associated with each of the target discharging locations. In a case in which a target discharging location is associated with a colored pixel of the image data, "1" is stored in a column "Ink Discharge" of the corresponding target discharging location. With respect to a column "Discharged", information whether ink has discharged to the corresponding target discharging location or not is stored.

The IJ print head controller 44 (or other functional components such as a CPU) generates the discharge control table based on the image data, performs a nozzle discharging appropriateness determination to determine whether to discharge ink to a target discharging position corresponding to a calculated position of the nozzle 61 calculated by the position calculation circuit 34. If the column "Ink Discharge" of the corresponding target discharging position is "1" and if the column "Discharged" of the corresponding target discharging position is "0", the IJ print head controller 44 determines that ink should be discharged. After the ink is discharged, the column "Discharged" of the corresponding target discharging position is set to "1".

<Example of Image Data Generation>

Figure 12A:
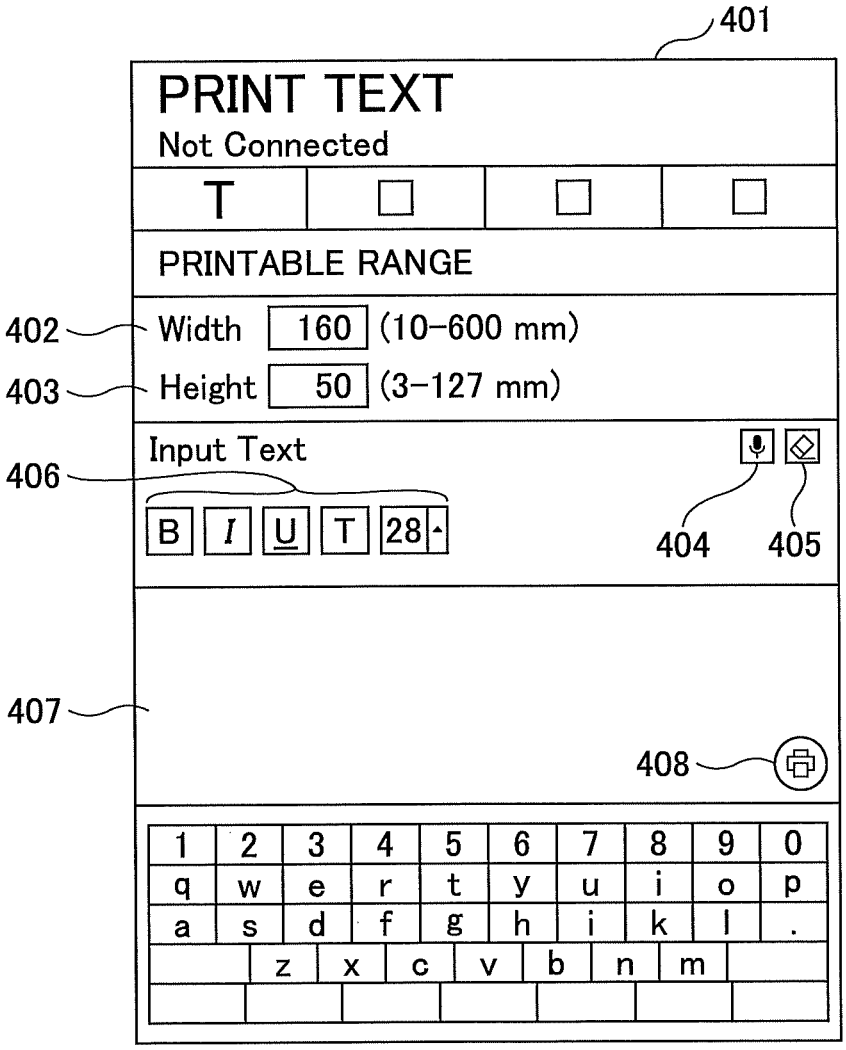
FIGS. 12A to 12C are examples of screens displayed on an LCD by the image data output device.
Figure 12B:
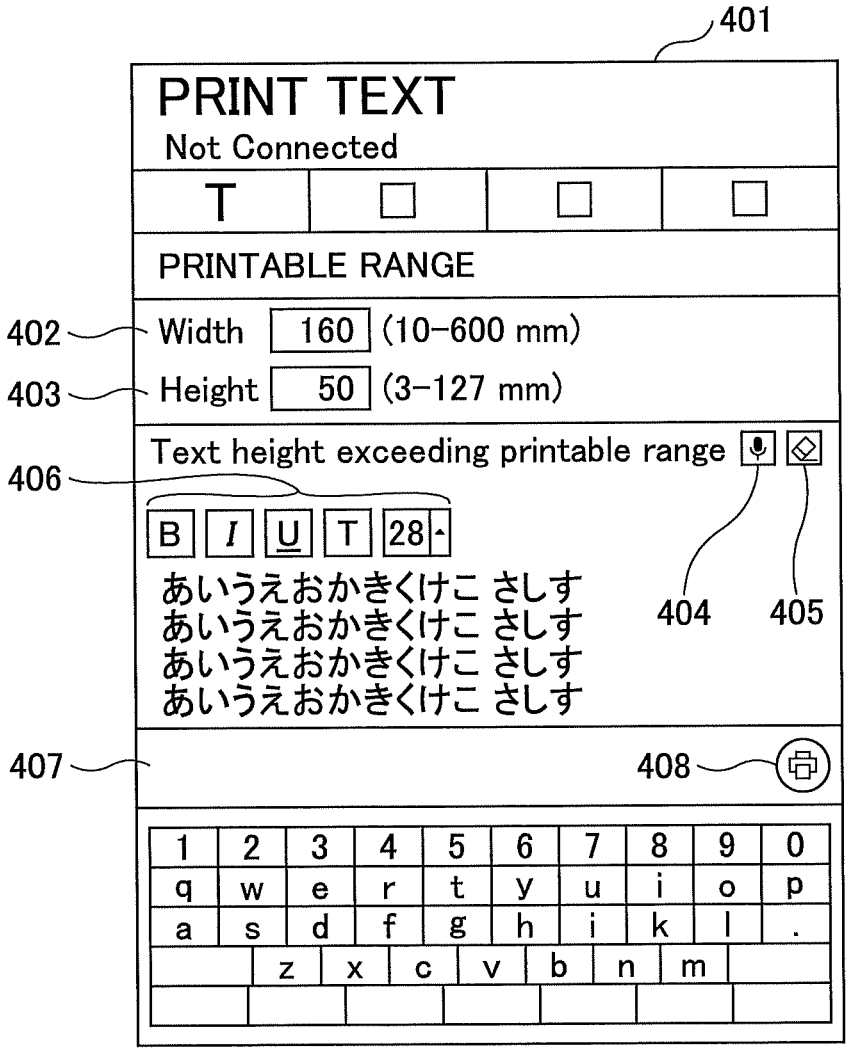
Figure 12C:
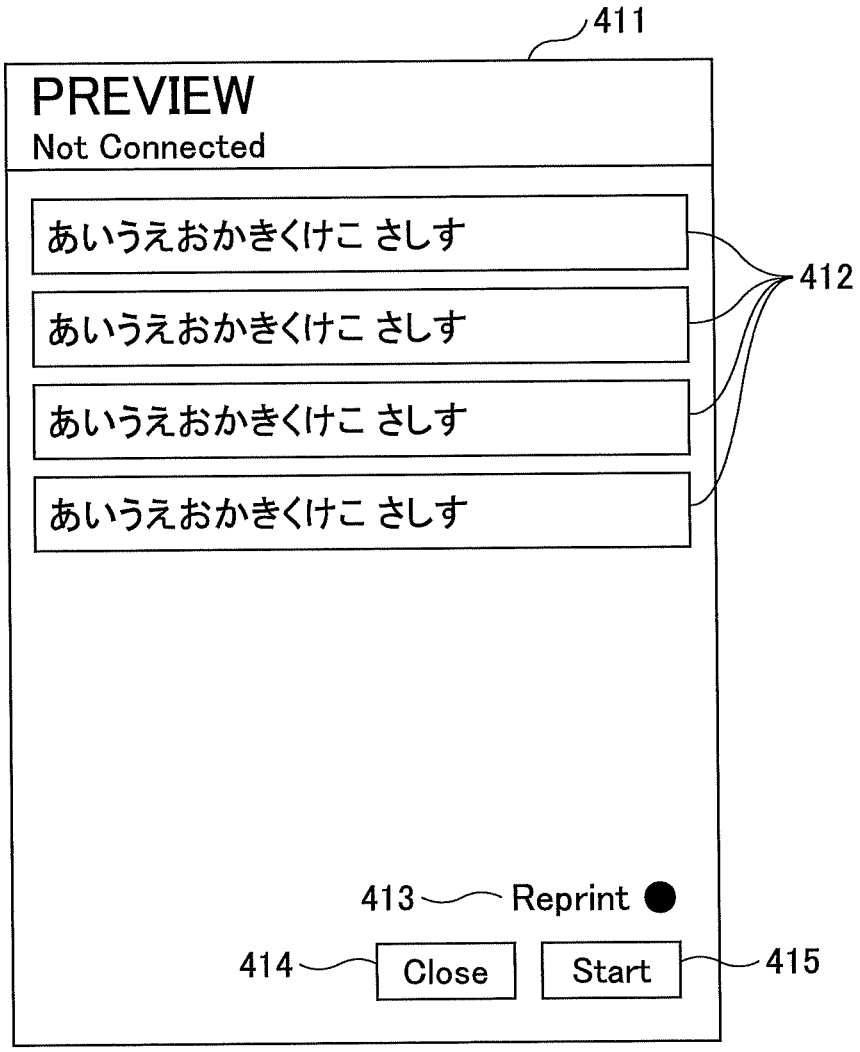

Next, examples of generation of image data will be described with reference to FIGS. 12A to 12C. FIGS. 12A to 12C are examples of screens displayed on the LCD 207 by the image data output device 11.

FIG. 12A is an example of a text input screen 401 in a state in which no text is input. The text input screen 401 includes a width setting field 402, a height setting field 403, a voice input icon 404, an eraser icon 405, text setting icons 406, a text display field 407, and a preview button 408.

The width setting field 402 is a field in which a user inputs a width of the printing medium 12, and the height setting field 403 is a field in which a user inputs a height of the printing medium 12. Because the HHP 20 is not equipped with a sheet conveyance mechanism, the HHP 20 cannot obtain information about a width and a height of the printing medium 12 to be used by a user. Hence, a user inputs a width and height (in millimeters for example) of the printing medium 12 to be used, into the width setting field 402 and the height setting field 403.

The voice input icon 404 is a button used when a user inputs text by voice, and the eraser icon 405 is a button used when a user deletes a character of text displayed on the text display field 407.

The text setting icons 406 are used for configuring a style (such as bold or italic) of a character, applying indication such as underline or strikethrough to a character, and setting a font size. A font size is generally, but not limited to, designated with a point number.

A user inputs text in the text display field 407. The operation receiving unit 53 receives the input operation, and the display control unit 52 displays the input text on the text display field 407.

When a user presses the preview button 408, the operation receiving unit 53 receives the operation, the preview generating unit 55 generates the preview screen 411, and the display control unit 52 displays the preview screen 411. FIG. 12C is an example of the preview screen 411. Details of a method for generating the preview screen 411 will be described below with reference to FIG. 15. On the preview screen 411, scanning paths 412 are mutually displayed in a distinguished manner. In the example illustrated in FIG. 12C, the number of the scanning paths 412 is 4. Accordingly, a user can immediately recognize how many scans are required.

The preview screen 411 includes a reprint button 413, a close button 414, and a start button 415. The reprint button 413 is used when a user instructs to print the same text again. The image data output device 11 is not required to send the same image data to the HHP 20 again. The close button 414 is used when the preview screen 411 is closed. The start button 415 is used when a user starts printing. Specifically, when the start button 415 is pressed, image data and scanning information are sent to the HHP 20.

<Determination of Printable Range>

It is preferable that text displayed in the text display field 407 is printed within a single page of the printing medium 12. Therefore, the preview generating unit 55 determines whether all text can be printed in the printing medium 12 or not, based on a font size, and values set to the width setting field 402 and the height setting field 403.

As line feed is automatically performed with respect to a character string not including a line feed, by considering a limitation of a width of the printing medium 12, a determination process of a line feed will be described first.

Figure 13A:
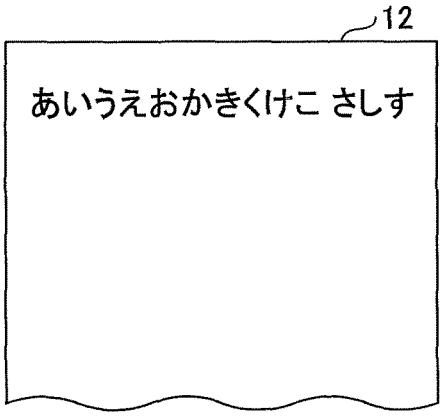
FIGS. 13A and 13B are diagrams illustrating an example of a concept of the determination process of a line feed.
Figure 13B:
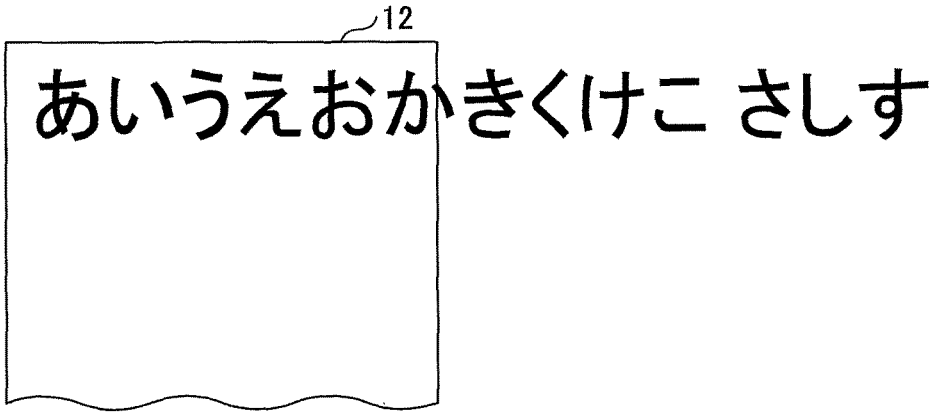

FIGS. 13A and 13B are diagrams illustrating an example of a concept of the determination process of a line feed. FIG. 13A illustrates an example of text determined not to require a line feed, and FIG. 13B illustrates an example of text determined to require a line feed. The print control unit 54 determines if a line feed is required or not by comparing "font size×number of characters" with "a value of the width setting field 402".

For example, regarding certain text, in a case in which a font size is 16 pt and the number of characters is 10, a length of the text is "16×0.35 [mm]×10=56 [mm]". If the value is not larger than a value of the width setting field 402, it is determined that a line feed is not required. Practically, a gap between characters is sometimes set automatically. In this case, since a length of text becomes longer than a length obtained by the above calculation, the gap is considered when calculating the length.

The preview generating unit 55 performs a similar determination with respect to a height. After the determination of a necessity of a line feed as described above with reference to FIGS. 13A and 13B, the number of lines is counted, and whether entire text can be printed within the printing medium 12 or not is determined based on a value set to the height setting field 403. As line spacing setting is made by a user or automatically so as not to overlap each line, the line spacing is considered when calculating the height.

Figure 14A:
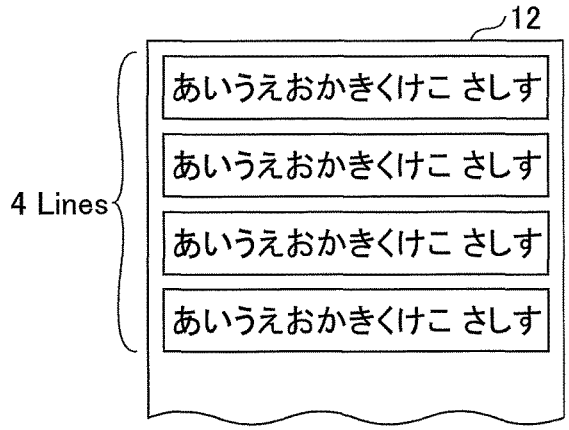
FIGS. 14A and 14B are diagrams illustrating an example of a concept of the determination of printable text against a printable range.
Figure 14B:
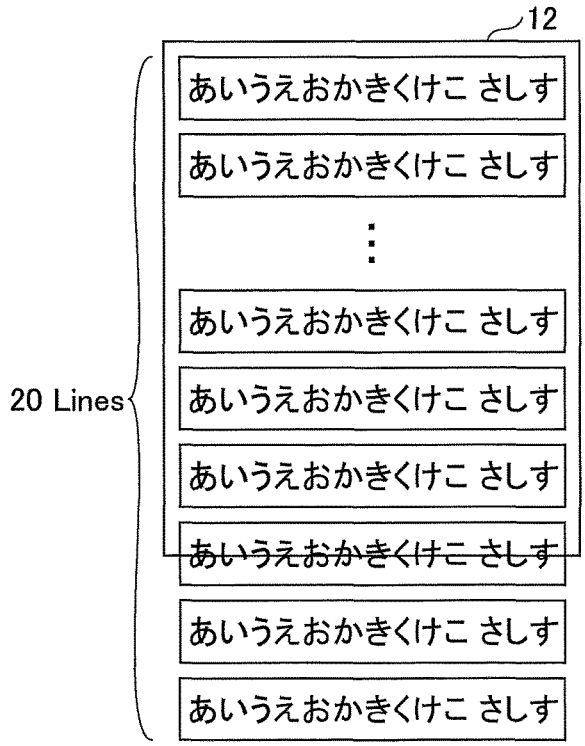

FIGS. 14A and 14B are diagrams illustrating an example of a concept of the determination of printable text against a printable range. FIG. 14A illustrates an example of text determined to be printable, and FIG. 14B illustrates an example of text determined not to be printable. The print control unit 54 determines if text is printable or not by comparing "font size×number of lines+(number of lines−1)×line spacing" with "a value of the height setting field 403".

For example, regarding certain text, in a case in which a font size is 16 pt, the number of lines is 4, and a line spacing is 5 [mm], a height of the text is "16×0.35 [mm]×4+3×5=37.4 [mm]". If the value is not larger than a value of the height setting field 403, it is determined that the text is printable. Further, if the number of lines of the text is 20, a height of the text is "16×0.35 [mm]×20+19×5=207 [mm]". If the value is larger than a value of the height setting field 403, it is determined that the text is not printable.

When the text is determined to be unprintable, the display control unit 52 displays a message such as "Text height exceeding printable range" on the text input screen 401. In response to the message, a user can decrease the number of characters of the text or decrease a font size of the text.

<Preview Screen Generation>

Figure 15:
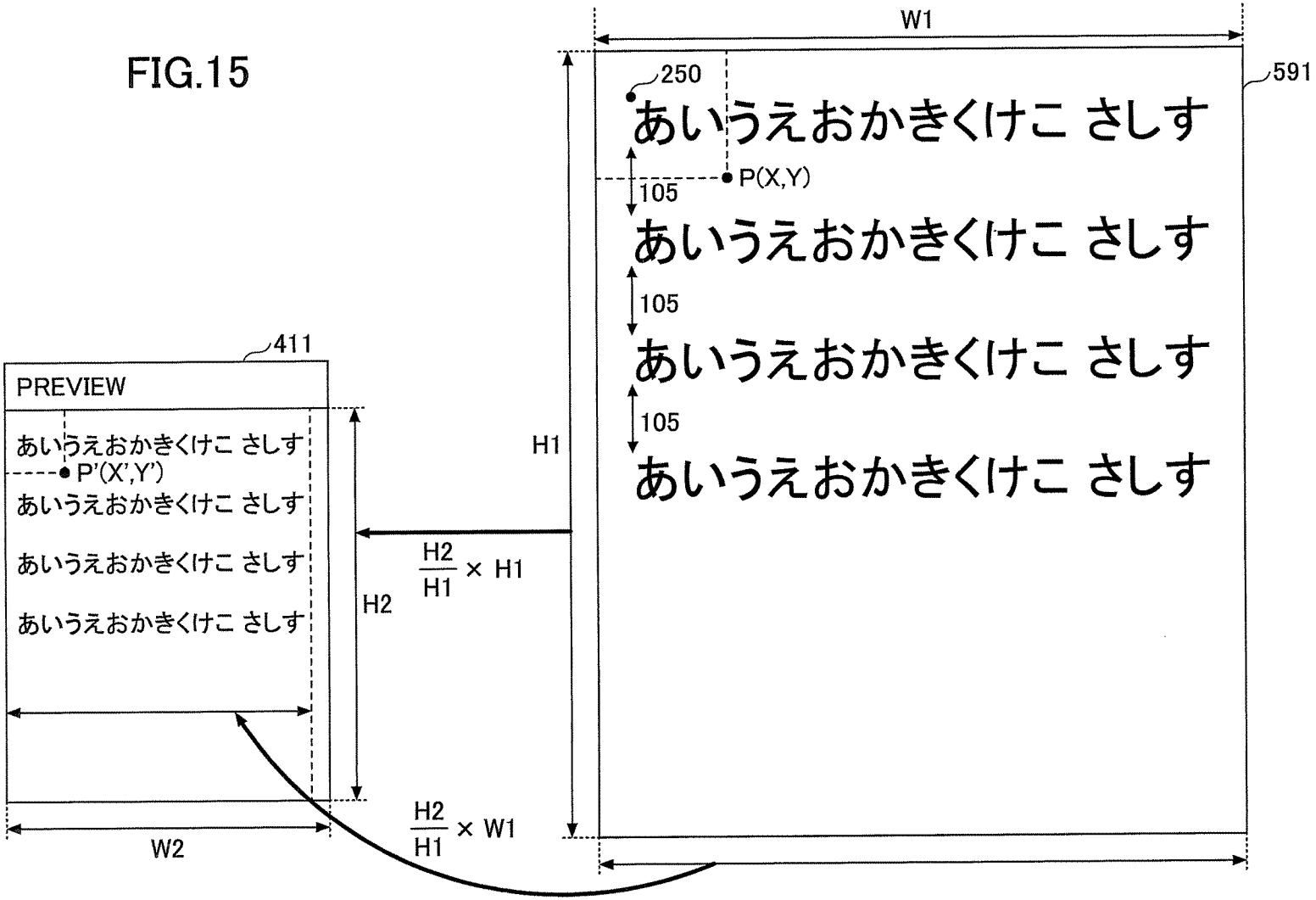
FIG. 15 is a diagram illustrating a method of generating a preview screen.

FIG. 15 is a diagram illustrating a method of generating the preview screen 411. The print control unit 54 converts text entered on the text input screen 401 into image data 591 (such as TIFF format data). The image data 591 is to be drawn by the HHP 20. First, a virtual plane is prepared for generating the image data 591. The numbers of pixels in a width direction and a height direction are determined by a width and a height of the printing medium 12 input by a user on the text input screen 401, and by a resolution of the HHP 20. In a case in which a width is 50 [mm] and a resolution is 300 dpi, since a distance between dots is 0.084 [mm], the number of pixels in a width direction is obtained by calculating "50÷0.084", which is approximately 595. The number of pixels in a height direction can be obtained in a similar manner.

Because it is not certain from which position printing is started by a user, the preview generating unit 55 starts, from a predetermined reference position 250, rasterization of a character code one by one in accordance with a font size. By this process, a character is represented by a set of dots. The reference position 250 is determined by considering an appropriate margin. For example, a position 5 to 10 [mm] distant from an upper end and a left end is determined as the reference position 250. Every time the preview generating unit 55 completes rendering an image corresponding to one line, the preview generating unit 55 renders an image corresponding to a next line by placing a line spacing 105 between the lines. As mentioned above, the line spacing is a predetermined value.

Next, the preview generating unit 55 downsizes the image data 591 such that a downsized image fits within the preview screen 411, while maintaining an aspect ratio of the image data 591. First, out of a height H1 of the image data 591 and a width W1 of the image data 591, the preview generating unit 55 determines which is larger. FIG. 15 illustrates a case in which H1 is larger than W1. Next, with a height (number of pixels) of a downsized image (represented by the downsized image data) to be displayed on the preview screen 411 represented as H2, the preview generating unit 55 calculates a ratio of H2 to H1 (=H2/H1). By multiplying the ratio by the height H1 and the width W1 of the image data 591, the image data 591 is downsized such that it fits in the preview screen 411 while maintaining an aspect ratio of the image data 591.

Similarly, a point P' (X', Y') on the preview screen 411 corresponding to a point P (X, Y) of the image data 591 is calculated by the following formulas:

$$X'=(H2/H1)\times X$$

$$Y'=(H2/H1)\times Y$$

By performing the above calculations, a position of text on the preview screen 411 can be calculated, and the preview generating unit 55 can display an arrow indicating a scanning direction.

Next, the preview generating unit 55 calculates the number of scanning paths. The number of scanning paths is a value representing how many scans are required (how many times a user needs to move the HHP 20 on the printing medium 12) to print entire text. A height of a printable image in a single scan is not larger than a length of the IJ print head 24 determined in a specification. In the following description, let the height be h [mm]. Since a size (point) of a character is limited to not larger than h in advance, multiple scanning paths are not required for printing a single line of text. Accordingly, quality degradation of a printed character can be avoided.

The preview generating unit 55 increases the number of lines (to be printed in a single scan) one by one, and determines whether a height of the lines is not larger than h. That is, the preview generating unit 55 calculates a height of two lines of text considering a font size of the text, and compares the height with h (the height of the IJ print head 24). If the height of the two lines is not larger than h (the height of the IJ print head 24), the preview generating unit 55 calculates a height of three lines of the text considering the font size of the text, and compares the height with h (the height of the IJ print head 24). The preview generating unit 55 repeats the process until it is determined that a height of n lines is larger than h. As a result, a maximum number of lines printable in a single scan is determined as (n−1) lines.

When a process of determining the number of lines printable in a single scan is repeatedly performed with respect to entire text (from a first line to the last line of text), the number of scanning paths required for printing entire text can be determined. When printing certain text that contains four lines, if a height of text corresponding to two lines is larger than h (the height of the IJ print head 24), the number of scanning paths is determined as 4.

Figure 16A:
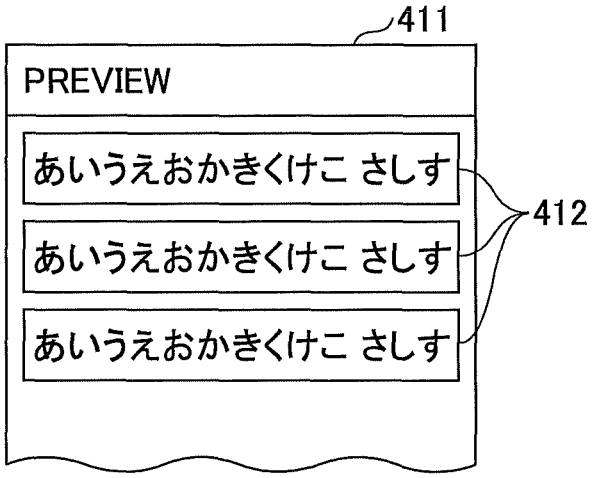
FIGS. 16A and 16B are diagrams illustrating examples of scanning paths.
Figure 16B:
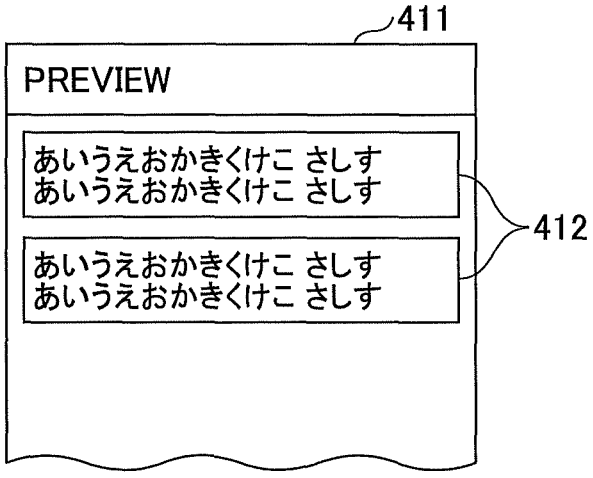

FIGS. 16A and 16B are diagrams illustrating examples of scanning paths. As illustrated in FIG. 16A or FIG. 16B, the preview generating unit 55 displays scanning paths 412 each indicating a region printable in a single scan, on the preview screen 411 in a distinguishable manner. FIG. 16A illustrates a case in which a single line of text is printed with a single scanning path 412, and FIG. 16B illustrates a case in which two lines of text are printed with another single scanning path 412. Specifically, each scanning path 412 is displayed in the same background color. That is, though background colors of a certain scanning path 412 and another scanning path 412 are the same, a background color of a region between scanning paths 412 is different from the background color of scanning paths 412. Accordingly, a user can recognize a specific scanning path 412 at a first glance. Note that the color scheme described above is merely an example, and any type of color scheme may be adopted as long as each scanning path 412 is displayed in a distinguishable manner. For example, a scanning path 412 may be displayed with the scanning path 412 surrounded by a rectangular frame. Alternatively, characters in a certain scanning path 412 may be displayed in a color different from colors of characters in other scanning paths.

<Information Exchanged Between Image Data Output Device and HHP>

Figure 17:
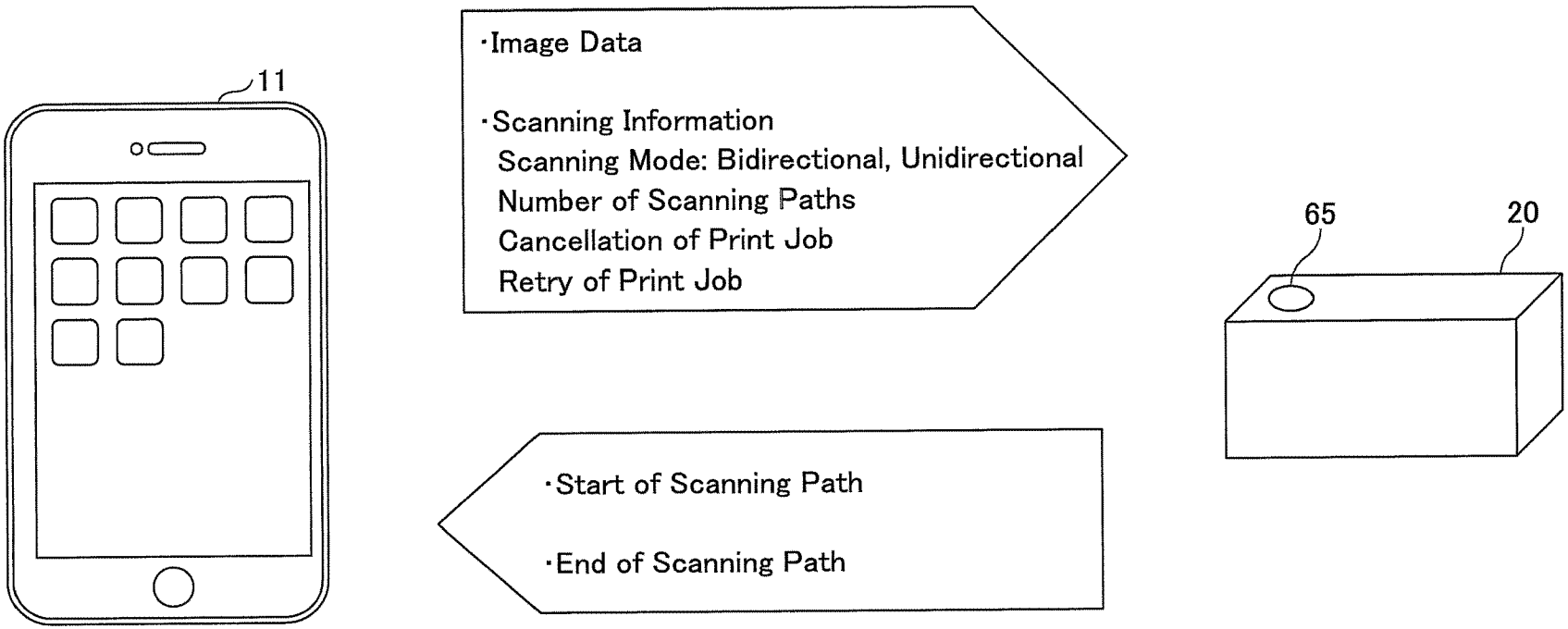
FIG. 17 is a diagram illustrating an example of information exchanged between the image data output device and the HHP.

FIG. 17 is a diagram illustrating an example of information exchanged between the image data output device 11 and the HHP 20. Information transmitted from the image data output device 11 to the HHP 20 mainly includes image data and scanning information. The image data is data generated by converting all text entered by a user into an image. Even if the number of scanning paths is more than one, the image data is transmitted all in a single transmission. However, image data may be transmitted on a per-scanning path 412 basis.

The HHP 20 includes a scan button 65. The scan button 65 is used by a user for sending a notification of a start and end of printing from the HHP 20 to the image data output device 11. While a user is moving the HHP 20 along with a single scanning path, the user presses the scan button 65 continuously. In a case in which a user does not intend to print, even if a user moves the HHP 20 (without pressing the scan button), droplets are not discharged from the HHP 20.

The scanning information includes, for example, a scanning mode (bidirectional or unidirectional), the number of scanning paths, and information indicating a cancellation or a retry of a print job.

Figure 18A:
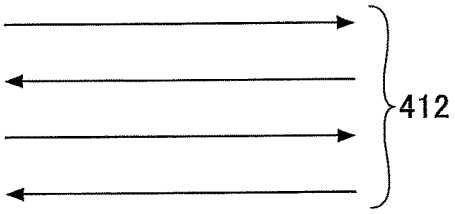
FIGS. 18A and 18B are diagrams illustrating examples of scanning modes.
Figure 18B:
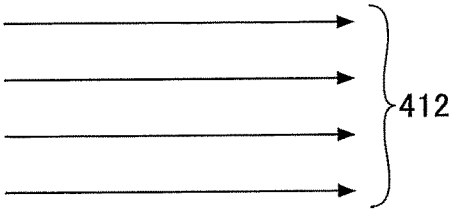

FIGS. 18A and 18B are diagrams illustrating examples of scanning modes. FIG. 18A is a diagram illustrating a scanning mode called a bidirectional mode (bidirectional scanning mode), and FIG. 18B is a diagram illustrating a scanning mode called a unidirectional mode (unidirectional scanning mode). In the bidirectional scanning mode, a user alternately performs movement of the HHP 20 from left to right, and movement of the HHP 20 from right to left. This mode is advantageous in that an amount of movement of the HHP 20 which must be done by a user is less than in the unidirectional mode. In the unidirectional scanning mode, a user moves the HHP 20 only from left to right (or only from right to left). This mode is advantageous in that a scanning operation is easy for a user since a scanning direction is always the same.

A scanning direction of a scanning path 412 corresponding to a first line may be predetermined or may be configurable by a user. In both cases (bidirectional mode and unidirectional mode) illustrated in FIGS. 18A and 18B, a scan is performed in the direction from left to right. A scanning direction of each scanning path 412 may be predetermined or may be configurable by a user. Further, a scanning direction may be configurable by a user for each scanning path 412.

Figure 19:
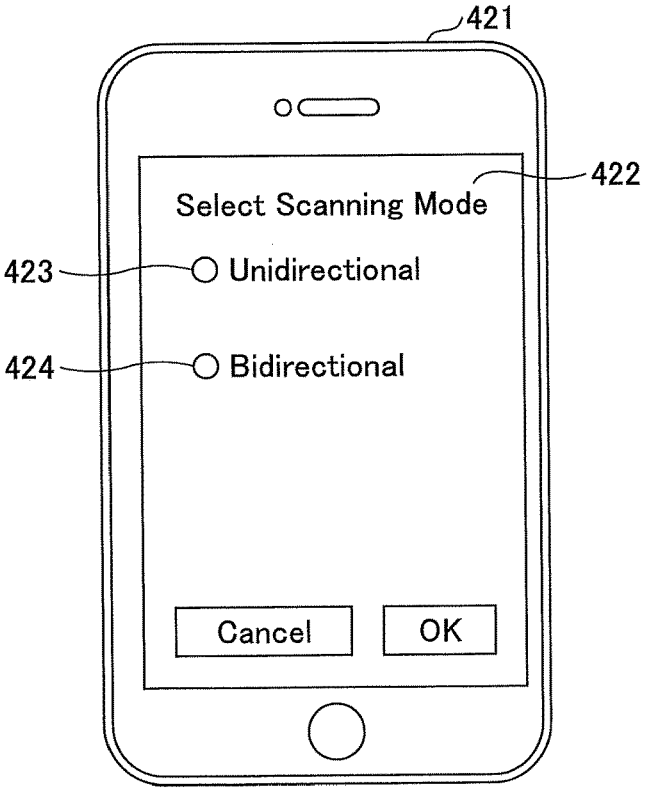
FIG. 19 is a view illustrating an example of a scanning direction configuration screen displayed on the image data output device.

As illustrated in FIG. 19, a user can configure a scanning mode by operating the image data output device 11. FIG. 19 is a view illustrating an example of a scanning direction configuration screen 421 displayed on the image data output device 11. The scanning direction configuration screen 421 includes a message 422 such as "Select Scanning Mode", and radio buttons 423 and 424 respectively corresponding to "unidirectional mode" and "bidirectional mode". A user selects one of the radio buttons 423 and 424. Note that a default value is configured in advance, which is used when a user does not select the radio button 423 or 424.

A selected scanning mode is transmitted to the HHP 20. In FIGS. 18A and 18B, each arrow represents a corresponding scanning path 412. The image data output device 11 maintains a scanning direction for each scanning path 412, and the HHP 20 can determine a scanning direction of each scanning path 412 based on a scanning mode.

At a time of a start of scan, a user presses the scan button 65 of the HHP 20, and the user keeps pressing the scan button 65 during the scan. When a scan of a single scanning path 412 terminates, the user releases the scan button 65. By detecting button operations, the HHP 20 and the image data output device 11 detect a start and end of a single scanning path 412.

Among the scanning information, the number of scanning paths is calculated as described above. The information indicating a cancellation of a print job is transmitted when a user cancels a print job by operating the image data output device 11. The information indicating a retry of a print job is transmitted when a user retries a print job by operating the image data output device 11. The "retry" means an operation in which printing of a scanning path 412 is executed again from the beginning, which is done when the HHP 20 has failed printing the scanning path 412 during a printing operation.

Information transmitted from the HHP 20 to the image data output device 11 mainly includes information indicating a start of a scan of a scanning path 412 and information indicating an end of a scan of a scanning path 412. The start of a scan of a scanning path 412 corresponds to a press operation of the scan button 65 by a user, and the end of a scan of a scanning path 412 corresponds to a release operation of the scan button 65 by a user. That is, information about a start of printing and an end of printing is transmitted to the image data output device 11.

<Overall Operation>

Figure 20:
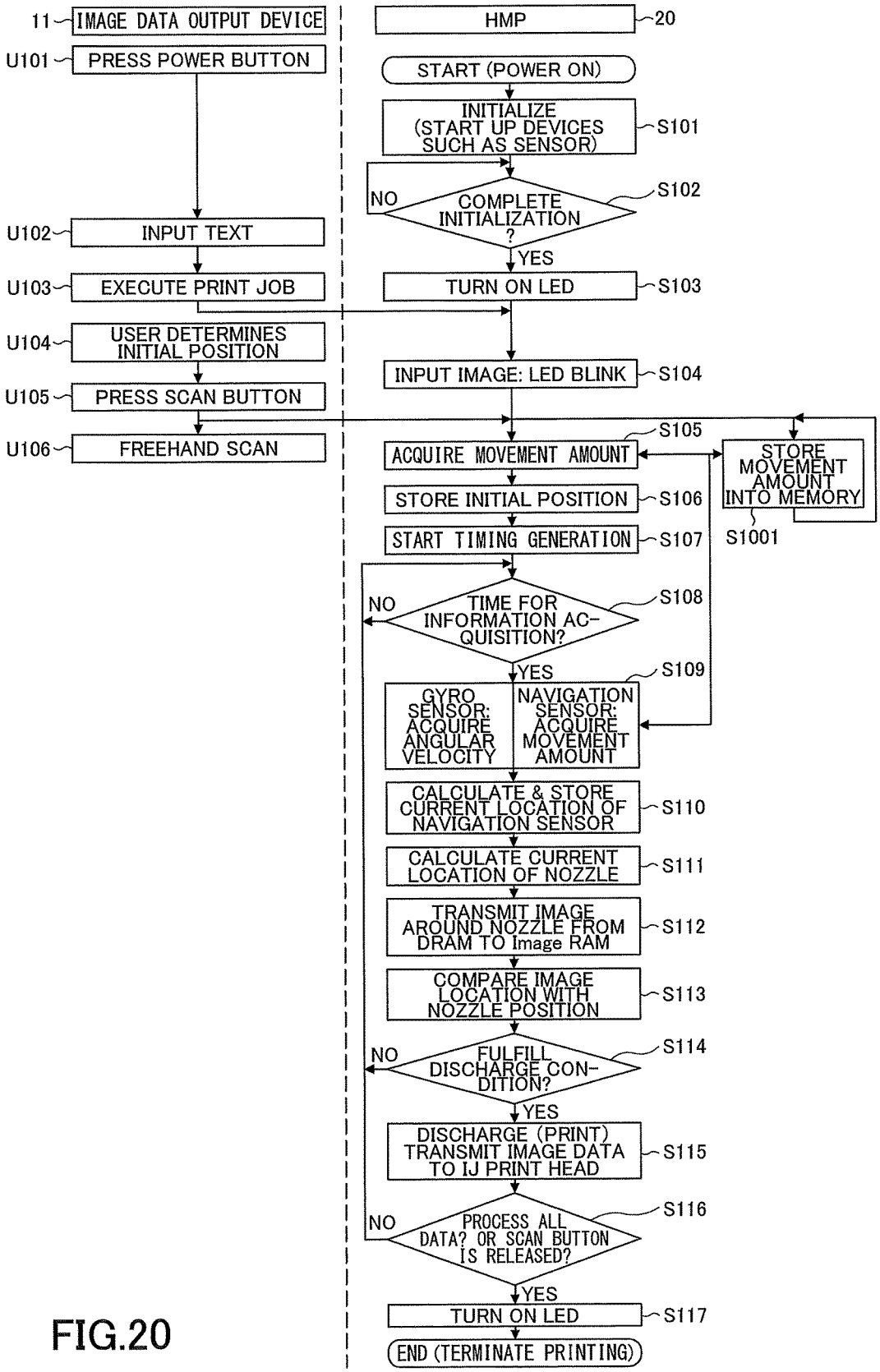
FIG. 20 is a flowchart illustrating an example of operation processes of the image data output device and the HHP.

FIG. 20 is a flowchart illustrating an example of operation processes of the image data output device 11 and the HHP 20. First, a user presses a power button of the image data output device 11 (U101). When the power button is pressed, the image data output device 11 is started, by receiving power from a power source such as a battery.

The user inputs text to be printed on the text input screen 401 (U102). The operation receiving unit 53 of the image data output device 11 receives the text input. When the user presses the preview button 408 to check a finished image, the operation receiving unit 53 receives the press operation of the button and the display control unit 52 displays the preview screen 411.

The user performs an operation to execute a print job for printing the input text (U103). Specifically, the user presses the start button 415 in the preview screen 411 to request an execution of the print job. The operation receiving unit 53 of the image data output device 11 receives the request to execute the print job. In response to receiving a request for the print job, image data and scanning information are transmitted to the HHP 20. Also, the print control unit 54 starts displaying a scanning direction on the preview screen 411 to let the user know the scanning direction. Details will be described below with reference to FIG. 23.

The user holds the HHP 20 and determines an initial position on a printing medium 12 (such as a notebook) (U104).

The user presses the scan button 65 and keeps pressing (U105). The HHP 20 receives the press operation of the scan button 65.

The user moves the HHP 20 by freehand such that the HHP 20 slides on the printing medium 12 (U106).

Next, the operation of the HHP 20 will be described. The operation to be described below is realized by the CPU 33 executing firmware.

The HHP 20 is started when power is turned on. The CPU 33 in the HHP 20 initializes hardware elements of the HHP 20 illustrated in FIG. 3 or 4 (S101). For example, registers of the navigation sensor I/F 42 and the gyro sensor I/F 45 are initialized, and a timing value is set to the printer/sensor timing generator 43. Also, a communication between the HHP 20 and the image data output device 11 is established. In a case in which a communication using Bluetooth (registered trademark) is to be performed, a procedure for pairing the HHP 20 with the image data output device 11 needs to be performed by the user in advance.

The CPU 33 in the HHP 20 determines whether the initialization is completed or not, and if the initialization has not been completed, the CPU 33 repeats the determination (S102).

When the initialization is completed (YES at S102), the CPU 33 in the HHP 20 notifies the user that the HHP 20 is ready for printing, by lighting of the LED of the OPU 26 for example (S103). By the notification, the user recognizes that the HHP 20 is ready for printing, and requests the execution of the print job as mentioned earlier.

When the execution of the print job is requested, the communication I/F 27 in the HHP 20 receives an input of image data from the image data output device 11. Notification of the image data input is sent to the user, by blinking of the LED of the OPU 26 (S104).

When the user determines an initial position of the HHP 20 and presses the scan button 65, the OPU 26 in the HHP 20 receives the operation and the CPU 33 causes the navigation sensor I/F 42 to detect an amount of movement in order to detect a position (S105). The navigation sensor I/F 42 acquires an amount of movement from the navigation sensor 30 by communicating with the navigation sensor 30, and stores the acquired amount of movement into a memory region such as a register (S1001). The CPU 33 reads the amount of movement from the navigation sensor I/F 42.

For example, the CPU 33 stores, as an initial position, coordinates (0, 0) into a memory region such as the DRAM 29 or a register of the CPU 33 since an amount of movement obtained just after the user pressed the scan button 65 is zero. However, even if the obtained amount of movement is not zero, the coordinates (0, 0) are stored (S106).

Further, when the initial position is determined, the printer/sensor timing generator 43 starts generating a timing (S107). When the printer/sensor timing generator 43 detects an instance of a timing of acquiring a movement amount of the navigation sensor 30 configured at the initialization step, the printer/sensor timing generator 43 sends the timing to the navigation sensor I/F 42 and the gyro sensor I/F 45.

The CPU 33 in the HHP 20 determines whether it is a time or not to acquire an amount of movement and an angular velocity (S108). The determination can be made by the CPU 33 receiving an interrupt from the interrupt controller 41, but as another embodiment, instead of using the interrupt controller 41, the CPU 33 may monitor time and detect an instance of time (which is equal to the timing sent by the printer/sensor timing generator 43) to acquire the above information.

When it is a time to acquire the amount of movement and the angular velocity (YES at S108), the CPU 33 in the HHP 20 acquires the amount of movement from the navigation sensor I/F 42 and acquires the angular velocity from the gyro sensor I/F 45 (S109). As described earlier, the gyro sensor I/F 45 acquires an angular velocity from the gyro sensor 31 at a timing sent from the printer/sensor timing generator 43 and the navigation sensor I/F 42 acquires an amount of movement from the navigation sensor 30 at a timing sent from the printer/sensor timing generator 43.

Next, the position calculation circuit 34 calculates a current position of the navigation sensor 30, by using the amount of movement and the angular velocity (S110). Specifically, to calculate the current position, the position calculation circuit 34 adds, to a position (X, Y) having been calculated at the previous time, a distance of movement calculated from the amount of movement ($\Delta X'$, $\Delta Y'$) and the angular velocity acquired most recently. If a position (X, Y) having been calculated at the previous time is not recorded, the current position of the navigation sensor 30 is calculated by adding to an initial position a distance of movement calculated from the amount of movement ($\Delta X'$, $\Delta Y'$) and the angular velocity acquired most recently.

Next, the position calculation circuit 34 calculates current positions of the respective nozzles 61, by using the current position of the navigation sensor 30 (S111).

As described above, because an amount of movement and an angular velocity are acquired (almost) simultaneously by the printer/sensor timing generator 43, positions of the nozzles 61 can be calculated from a rotating angle and an amount of movement obtained at a same time as the rotating angle. Accordingly, although the HHP 20 calculates positions of the nozzles 61 using two types of information obtained from different sensors, a preciseness of positions of the nozzles 61 can be maintained.

Next, the CPU 33 causes the DMAC 38 to transmit image data of an image around each of the nozzles 61 from the DRAM 29 to the image RAM 37 (S112). The image around the nozzles 61 (hereinafter referred to as a "neighboring image") can be identified based on the calculated positions of the nozzles 61. At this time, the rotating unit 39 rotates the image data, based on a position of the IJ print head 24 (depending on how the HHP 20 is held) and a degree of lean of the IJ print head 24.

Next, the IJ print head controller 44 compares coordinates of each pixel constituting the neighboring image with coordinates of each of the nozzles 61 (S113). The position calculation circuit 34 calculates acceleration of the nozzles 61 by using a current position and a past position of the nozzles 61. Although an ink discharging cycle of the IJ print head 24 is shorter than a cycle of acquisition of an amount of movement by the navigation sensor I/F (or a cycle of acquisition of an angular velocity by the gyro sensor I/F 45), the position calculation circuit 34 can estimate the positions of the nozzles 61 for each ink discharging cycle of the IJ print head 24, by using the acceleration. The IJ print head controller 44 determines whether the coordinates of the pixel are included within a predetermined range from the position of the nozzles 61 calculated by the position calculation circuit 34.

If a discharge condition is not satisfied (NO at S114), the process reverts to step S108. If a discharge condition is satisfied (YES at S114), the IJ print head controller 44 outputs, to the IJ print head actuating circuit 23, pixel data for each nozzle (S115). By performing the step (S115), ink is discharged to the printing medium 12. The IJ print head controller 44 also updates the discharge control table.

Next, the CPU 33 determines whether all the image data is output (processed) or the scan button 65 is released (S116). If the determination at step S116 is negative (NO at S116), the process from steps S108 to S115 is repeated.

If the determination at step S116 is positive (YES at S116), the CPU 33 notifies the user that the printing is completed, by turning on the LED of the OPU 26, for example (S117).

As the HHP 20 also sends a notification to the image data output device 11 that a scan of a scanning path 412 has terminated, the print control unit 54 in the image data output device 11 terminates displaying the scanning direction on the corresponding scanning path 412. Subsequently, the print control unit 54 displays a line feed direction, and displays a scanning direction on a next scanning path 412. Details will be described below with reference to FIG. 23.

<Displaying Scanning Direction>

Figure 21A:
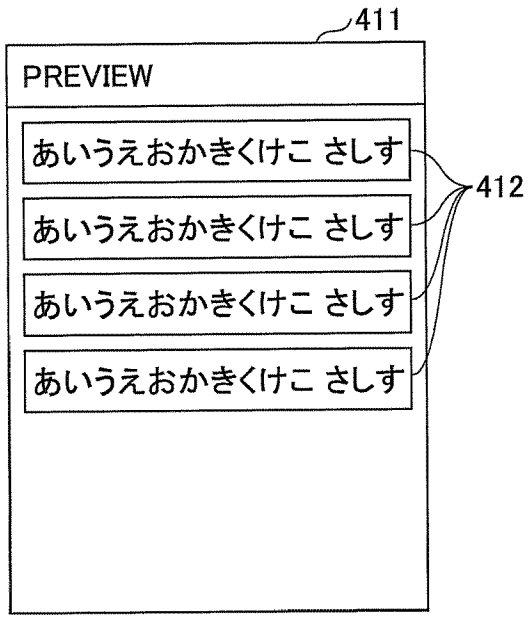
FIGS. 21A to 21C are diagrams illustrating an example of displaying the scanning direction.
Figure 21B:
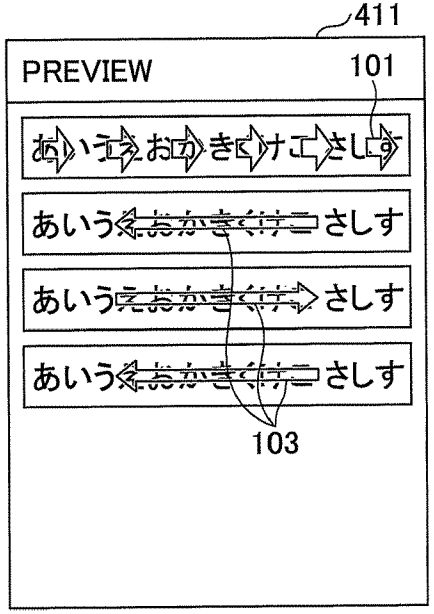
Figure 21C:
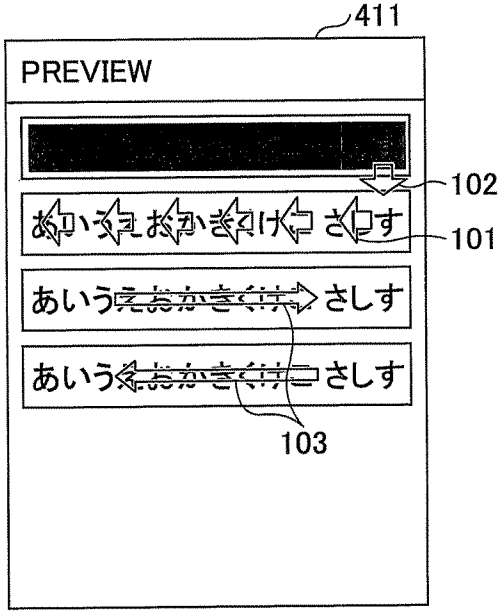

FIGS. 21A to 21C are diagrams illustrating an example of displaying the scanning direction. FIG. 21A illustrates a display example of the preview screen 411, and FIG. 21B illustrates a display example of an arrow 101 indicating the scanning direction on the preview screen 411. FIG. 21C illustrates a display example of an arrow 102 (a second arrow) indicating a line feed direction which is displayed when a print operation corresponding a certain scanning path 412 is terminated.

The preview generating unit 55 displays the arrow 101 indicating the scanning direction, by superimposing the arrow 101 on a scanning path 412 in the preview screen 411. Similar to the method of generating the preview screen 411 with reference to FIG. 15, a location of each scanning path 412 in the preview screen 411 is calculated by using coordinates of each line of the image data 591 and the ratio H2/H1.

The arrow 101 is displayed as an animated image which gradually moves, although the arrow 101 illustrated in FIG. 21B looks like a still image. FIGS. 22A to 22D are diagrams illustrating an example of displaying the arrow 101 as an animated image. FIGS. 22A, 22B, 22C, and 22D each represent the preview screen 411 at a different time. As illustrated in FIGS. 22A to 22D, the preview generating unit 55 periodically moves a display location of the arrow 101 indicating the scanning direction horizontally; thus, the arrow 101 can be displayed as if it were moving. As the arrow 101 indicating the scanning direction gradually moves towards the right, a user can easily grasp a scanning direction. Note that the number of arrows 101 displayed on the preview screen 411 is not limited to 1. The preview generating unit 55 may display multiple arrows 101 simultaneously.

As illustrated in FIG. 21B, on a scanning path 412 that is being scanned, the preview generating unit 55 displays the animated arrow 101, and on the rest of scanning paths 412, the preview generating unit 55 displays background arrows 103 as still images. In another embodiment, the arrow 101 may be displayed statically, and the background arrows 103 may be displayed as animated images. However, since some of the background arrows 103 have an opposite direction of the arrow 101 during a bidirectional scanning mode, it is preferable that the background arrows 103 are displayed inconspicuously compared to the arrow 101. The background arrows 103 are displayed, for example, in a light translucent color.

Accordingly, since a user can grasp a scanning direction of a scanning path 412 following a current scanning path 412 in advance, after a print operation of a certain scanning path 412 is completed, the user is not uncertain regarding the scanning direction of a scanning path 412 to be scanned next. In a case in which a unidirectional mode is selected as a scanning mode, the preview generating unit 55 displays the background arrows 103 such that all the displayed background arrows 103 will be "→". Conversely, in a case in which a bidirectional mode is selected as a scanning mode, "→" and "←" are displayed as the background arrow 103 alternately in each row.

Further, as illustrated in FIG. 21C, the preview generating unit 55 causes a scanning path 412 corresponding to a row having been printed to be grayed out. The "grayed out" means a display method for inconspicuously displaying an element (a line or text) with low brightness or low contrast. The preview generating unit 55 can notify a user, by causing a scanning path 412 to be grayed out, that a print operation of a row corresponding to the scanning path 412 has terminated.

An arrow 102 illustrated on the preview screen 411 in FIG. 21C, which indicates a line feed direction, is displayed when a user releases the scan button 65. The preview generating unit 55 displays the arrow 102 starting from a right end of a scanning path 412 and directed to a downward direction perpendicular to a scanning direction of the scanning path 412. It is also preferable that the arrow 102 is displayed as an animated image. Although the arrow 102 is different from the arrow 101 with respect to a direction, a moving direction, and a moving amount, a display of the arrow 102 by animation is realized in a similar manner to that of the arrow 101. A location (coordinates) of the end of a scanning path 412 on the preview screen 411 is calculated from coordinates of an end of a line in the image data 591 and the ratio H2/H1. FIG. 21C illustrates a case in which a scan is performed from a left end to a right direction, but when a scan is performed from a right end to a left direction, the preview generating unit 55 displays an arrow 102 starting from a left end of a scanning path 412 and directed to a downward direction perpendicular to a scanning direction of the scanning path 412.

Figure 22A:
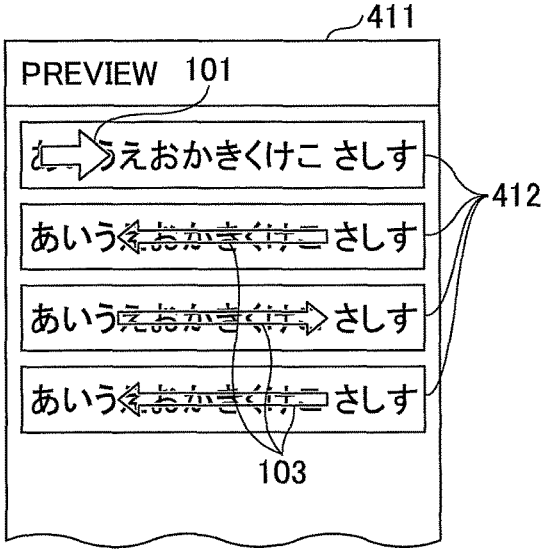
FIGS. 22A to 22D are diagrams illustrating an example of displaying an arrow as an animated image.
Figure 22B:
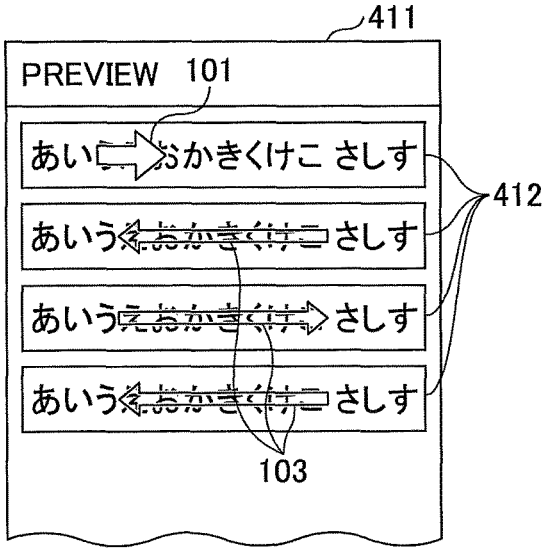
Figure 22C:
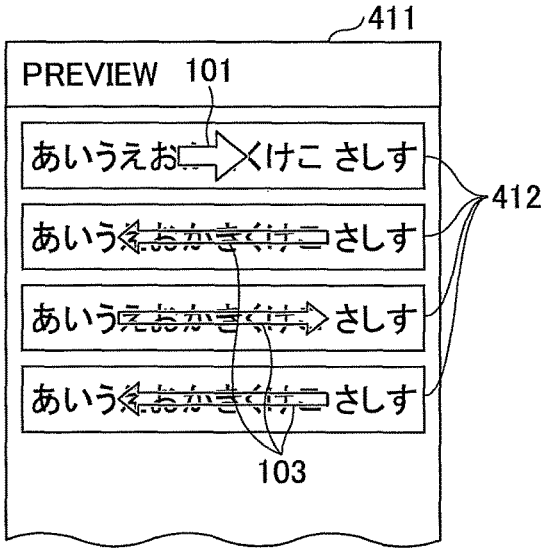
Figure 22D:
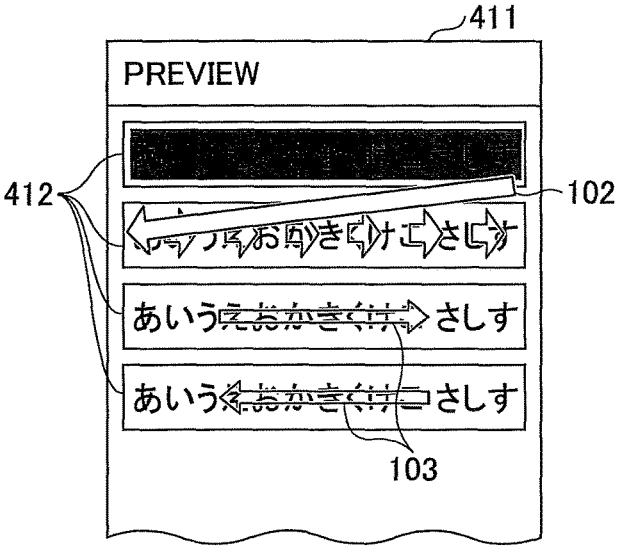

FIG. 21C also illustrates an arrow 102 displayed in a bidirectional mode. In a unidirectional mode, an arrow 102 is displayed as illustrated in FIG. 22D. That is, an arrow 102 is displayed so as to connect an end of one scanning path 412 and a start position of a next scanning path 412.

<Process for Displaying Scanning Direction>

Figure 23:
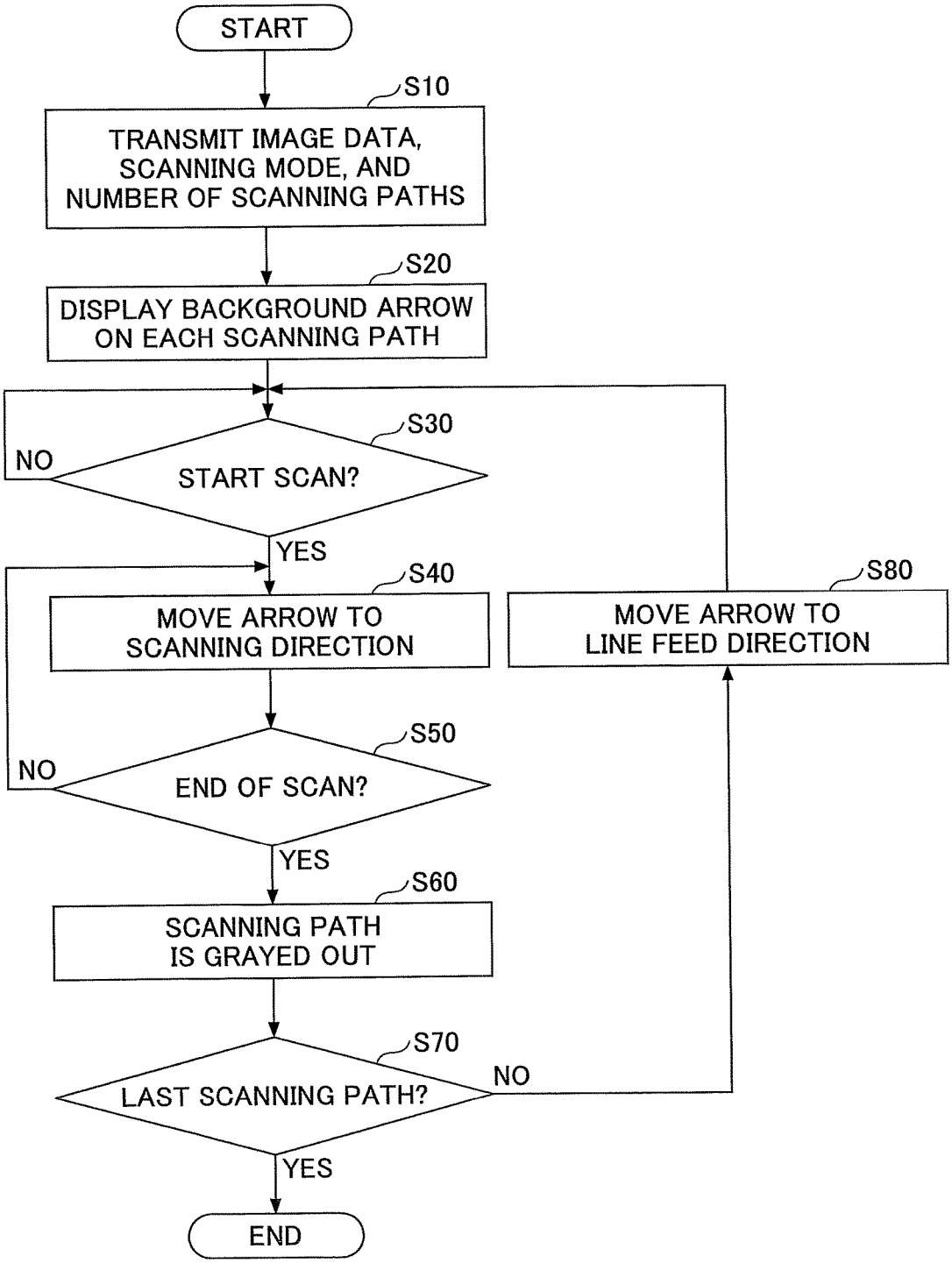
FIG. 23 is a flowchart illustrating an example of a process performed by the image data output device displaying the scanning direction.

FIG. 23 is a flowchart illustrating an example of a process performed by the image data output device 11 displaying the scanning direction. The process illustrated in FIG. 23 starts when a user presses the start button 415 in the preview screen 411.

First, the communication unit 51 of the image data output device 11 transmits image data and scanning information to the HHP 20 (S10).

Next, the preview generating unit 55 displays the background arrow 103 on each scanning path 412, in accordance with a scanning mode (S20).

The preview generating unit 55 determines whether the communication unit 51 has received information indicating a start of a scan of a scanning path 412 from the HHP 20 (S30). The preview generating unit 55 waits until the information is received.

When the determination at step S30 becomes positive (YES at S30), the preview generating unit 55 displays, by animation, an arrow 101 representing a scanning direction of a scanning path 412 at a first line (S40).

While the user keeps pressing the scan button 65 (NO at S50), the preview generating unit 55 repeats display operations of the arrow 101 representing a scanning direction by animation.

If the user releases the scan button 65 (YES at S50), the preview generating unit 55 causes a scanning path 412 corresponding to a row of which a print has been completed to be grayed out (S60).

The preview generating unit 55 determines whether the scanning path 412 having been grayed out at the previous step (S60) is the last scanning path 412 or not (S70). When the preview generating unit 55 receives information indicating a start of a scan of a scanning path 412 and information indicating an end of the scan of the scanning path 412, the preview generating unit 55 determines that the scan of the scanning path 412 is completed, and increments the number of completed scanning paths 412 by 1. When the number of completed scanning paths 412 becomes equal to the number of scanning paths, it is determined that a print operation corresponding to the last scanning path 412 is completed.

If the determination at step S70 is negative (NO at S70), the preview generating unit 55 displays an arrow 102 indicating a line feed direction (S80). After step S80, the process reverts to step S30, and the preview generating unit 55 repeats steps S30 to S60.

As described above, because the image data output device 11 displays an arrow indicating a scanning direction and an arrow 102 indicating a line feed direction in real time in accordance with a scanning operation by a user, the user can easily determine a scanning direction of the HHP 20.

Although the HHP 20 can print an image depending on a position of the HHP 20 moved by a user's freehand scanning operation, if a path scanned by the HHP 20 is largely deviated from an ideal scanning path, errors in a position estimated by the navigation sensor 30 would be accumulated and a quality of a printed image is degraded as compared to a case in which the HHP 20 scans an ideal scanning path. For example, if a user were to move the HHP 20 in a direction opposite the ideal scanning path, errors in a position might be accumulated. As the image data output device 11 according to the present embodiment displays a scanning direction, degradation of an image quality can be reduced.

<When Position Information is Transmitted from HHP to Image Data Output Device>

Since the HHP 20 is continuously calculating the position of the nozzle 61 of the HHP 20, the HHP 20 is capable of periodically transmitting the position information to the image data output device 11.

If the position information is provided from the HHP 20, the image data output device 11 can grasp a state of progress of a print job (to what extent an image is printed). Accordingly, the image data output device 11 can control the arrow 101 indicating a scanning direction and an amount of a scanning path 412 to be grayed out, in accordance with the position information.

Figure 24:
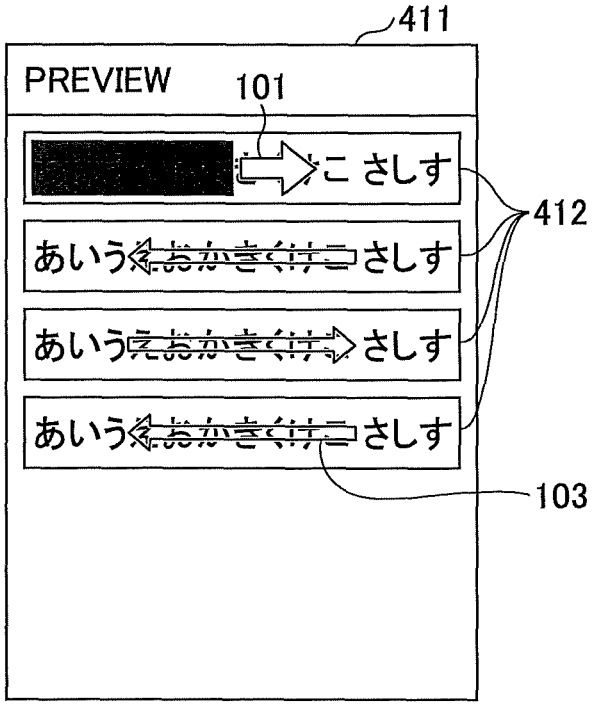
FIG. 24 is a diagram illustrating an example of the preview screen when position information is used.

FIG. 24 is a diagram illustrating an example of the preview screen 411 when the position information is used. The preview generating unit 55 causes a part of a scanning path 412 from a beginning of the scanning path 412 to a point corresponding to a current position of the HHP 20 (can be identified by the position information) to be grayed out, in order to indicate that the grayed out region has been printed. Also, with respect to a point identified by the position information, an arrow 101 indicating a scanning direction is displayed only on the same part as the end of the scanning path 412. It is also preferable that the arrow is displayed by animation such that the arrow is gradually moving.

Therefore, a user can grasp to what extent the HHP 20 has completed printing. Also, because the HHP 20 must be located at a position corresponding to an end of the grayed out region in a scanning path 412, the user can also grasp a current location of the HHP 20 by the image data output device 11.

Note that, even in a case in which the HHP 20 is configured to transmit the entire discharge control table or the latest X coordinate in the discharge control table whose corresponding column "Discharged" is changed to "1", similar information can be displayed. By receiving such information, because the image data output device 11 can grasp a state of progress of a print job (to what extent an image is printed), the image data output device 11 can display information similar to FIG. 24. Note that, as the discharge control table contains the target discharging location, the image data output device 11 can convert the target discharging location into coordinates on the preview screen 411 to display the grayed out region.

Further, if the image data output device 11 can obtain position information, the following information can also be displayed:

If the HHP 20 is being moved towards a different direction from a direction to which the HHP 20 should be moved for printing image data, the image data output device 11 displays an alert.

When displaying an arrow indicating a line feed direction (such as the arrow 102), the image data output device 11 also displays an amount of line feed.

Figure 25:
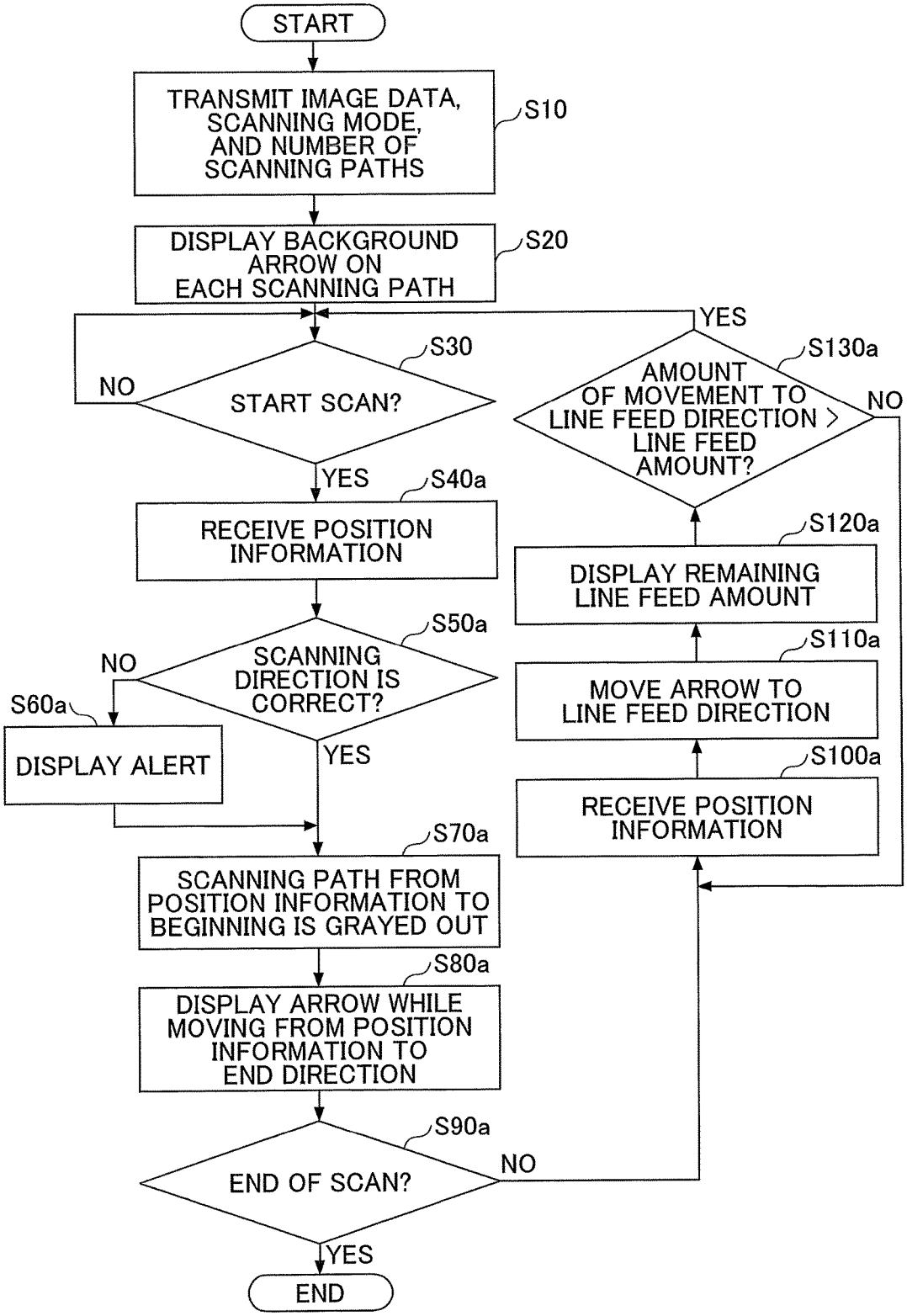
FIG. 25 is a flowchart illustrating an example of a process related to display of the scanning direction performed by the image data output device in a case in which the image data output device is capable of obtaining position information.

FIG. 25 is a flowchart illustrating an example of a process related to display of a scanning direction performed by the image data output device 11 in a case in which the image data output device 11 is capable of obtaining position information. Operations performed at steps S10 to S30 are similar to the steps illustrated in FIG. 23.

At step S40*a*, the communication unit 51 of the image data output device 11 receives position information from the HHP 20 (S40*a*). The image data output device 11 can acquire the position information by issuing a request to the HHP 20. Alternatively, the droplet discharging system may be configured such that the HHP 20 periodically transmits the position information.

The preview generating unit 55 determines whether a user is moving the HHP 20 toward a correct direction (S50*a*). Because the preview generating unit 55 retains a scanning direction for each scanning path 412, the preview generating unit 55 can determine whether change of the position information is the same as the scanning direction. Alternatively, if a difference (the shortest distance) between a scanning path 412 and the position information is not less than a threshold, the preview generating unit 55 can determine that a user is not moving the HHP 20 toward a correct direction.

Figure 26A:
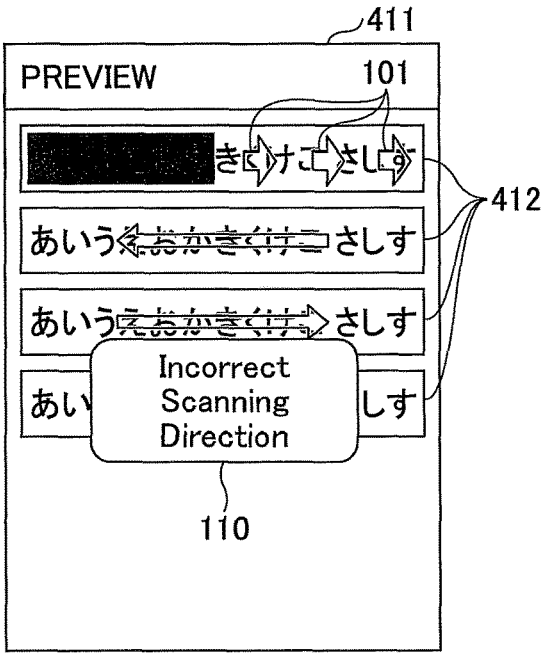
FIGS. 26A and 26B are diagrams illustrating examples of alerts displayed on the screen.

In a case in which the HHP 20 is, not being moved toward a correct direction, the display control unit 52 displays an alert on the preview screen 411, by using a popup window or the like (S60*a*). An example of display is illustrated in FIG. 26A.

The preview generating unit 55 causes a part of a scanning path 412 from a beginning of the scanning path 412 to a point identified by the position information to be grayed out (S70*a*). The preview generating unit 55 also displays the arrow 101 on the same side as the end of the scanning path 412 with respect to a point identified by the position information (S80*a*).

Next, the preview generating unit 55 determines whether scanning of a scanning path 412 is completed or not (S90*a*). Steps S40*a* to S80*a* are repeated until the scanning of the scanning path 412 is completed.

When the scanning of the scanning path 412 is completed, the preview generating unit 55 receives the position information via the communication unit 51 (S100*a*). Note that the position information is transmitted at an appropriate timing.

Next, the preview generating unit 55 displays the arrow 102 indicating a line feed direction (S110*a*).

Next, the preview generating unit 55 displays a remaining line feed amount (S120*a*). A line feed amount is predetermined as a length between lines. The preview generating unit 55 will have been accumulating an amount of movement in a vertical direction from a time at an end of scan (when the scan button 65 is released) to the present time, and displays, as the remaining line feed amount, a difference between the length between lines and the accumulated amount of movement. Accordingly, the user can grasp how much longer the HHP 20 should be moved in a line feed direction. An example of display of a remaining line feed amount is illustrated in FIG. 26B.

When in the unidirectional scanning mode, it is preferable to display line feed amounts of a horizontal direction and a vertical direction. A line feed amount of a horizontal direction is an amount of movement from a position at the end of scan (when the scan button 65 is released) to a start of a next scanning path 412. By displaying such information, the user can print each scanning path 412 in a state in which an appropriate line spacing is provided between scanning paths 412 and a beginning of each scanning path 412 is aligned. The preview generating unit 55 determines whether the amount of movement in a vertical direction is larger than a line feed amount (S130*a*). If the determination at step S130*a* is negative (NO at S130*a*), the preview generating unit 55 repeats steps S100*a* to S120*a*.

If the determination at step S130*a* is positive (YES at S130*a*), the preview generating unit 55 performs a display process with respect to a next scanning path 412 after the scan button 65 is pressed. FIG. 26A is an example of a diagram displayed when a scanning direction is not correct (when the HHP 20 is moved toward an incorrect direction). In FIG. 26A, an alert 110 "Incorrect Scanning Direction" is displayed. Because a user can modify a scanning direction early by seeing the alert, accumulation of errors in a position can be avoided, and degradation of an image quality can be reduced.

Figure 26B:
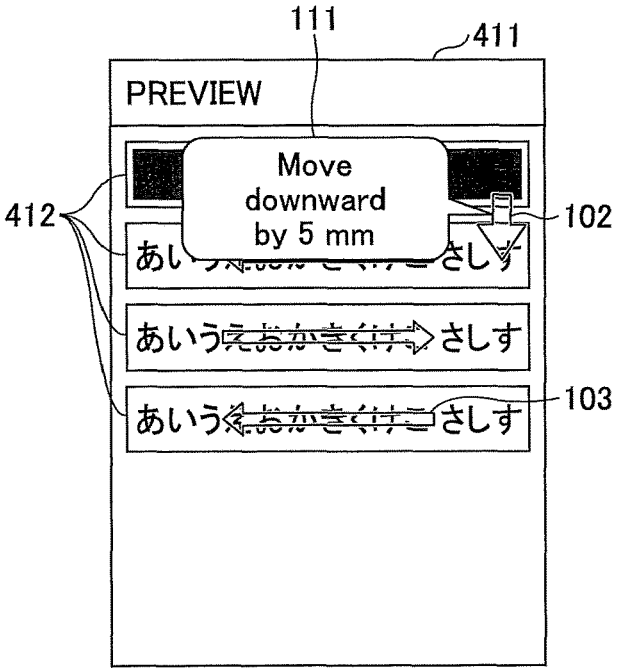

FIG. 26B is a display example of a remaining line feed amount. In FIG. 26B, a message 111 "Move downward by 5 mm" is displayed. This "5 mm" is updated in real time as a user moves the HHP 20 in a line feed direction, and the user can print a next scanning path 412 after moving the HHP 20 by an appropriate line feed amount. For example, lines can be printed in a manner in which the same spacing is provided between each of the lines.

<Other Display Examples>

While the HHP 20 is being moved by a user, the image data output device 11 cannot acquire position information in the following cases:

- When the HHP 20 deviates from a printing medium (in this case, the HHP 20 loses position information)
- When the user moves the HHP 20 too quickly (in this case, the HHP 20 loses position information)
- When communication between the HHP 20 and the image data output device 11 is disconnected (in this case, the HHP 20 retains position information)

In the above cases, the image data output device 11 acquires information from the HHP 20 indicating that position information cannot be obtained, instead of position information. Accordingly, the preview generating unit 55 displays an alert on the preview screen 411 to prompt a user to select a retry or a cancellation of a print job.

Figure 27A:
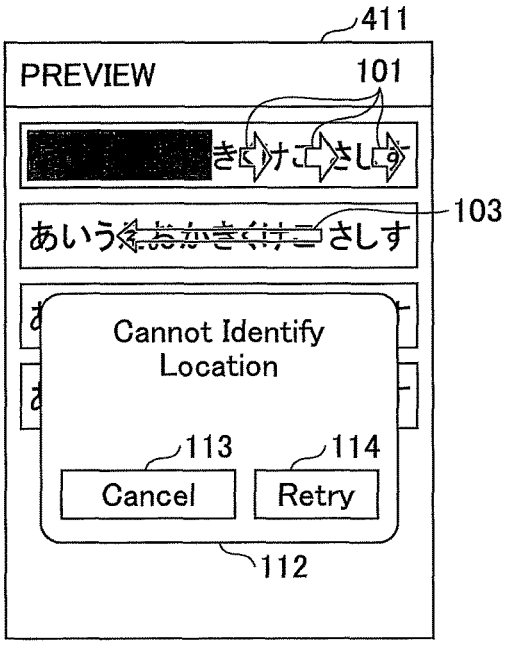
FIGS. 27A to 27C are diagrams illustrating examples of objects displayed by the preview generating unit.

FIG. 27A is an example of an alert 112 displayed by the preview generating unit 55 when position information cannot be acquired. In FIG. 27A, the alert 112 "Cannot Identify Location" is displayed with a cancel button 113 and a retry button 114. The cancel button 113 is used for terminating printing forcibly, and the retry button 114 is used for executing print processing again from the beginning of a scanning path 412.

In a case in which a user has pressed the retry button 114, the image data output device 11 cancels displaying the arrow 101 indicating a scanning direction and cancels grayed out display of a scanning path 412 (from a beginning of the scanning path 412 to a current position). When an event that the scan button 65 is pressed is detected, the display of the arrow 101 indicating a scanning direction is started with respect to the scanning path 412 in which printing was suspended.

In a case in which a user has pressed the cancel button 113, the image data output device 11 cancels displaying the arrow 101 indicating a scanning direction, displaying the background arrow 103, and cancels grayed out display of a scanning path 412. When the HHP 20 receives information indicating that the cancel button 113 has been pressed, the HHP 20 deletes image data and scanning information from the DRAM 29.

Figure 27B:
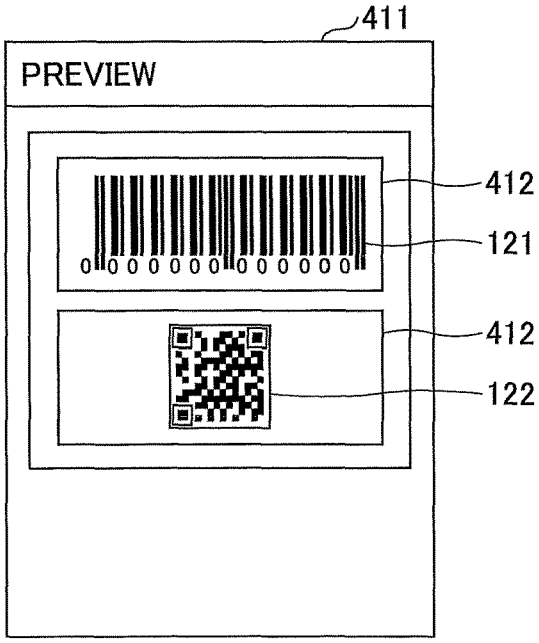

In the above embodiment, a case in which text data is printed has been described. However, it is also possible to print a barcode or a two-dimensional barcode by the HHP 20. FIG. 27B is a preview screen 411 of a barcode 121 and a two-dimensional barcode 122. Note that a height of the barcode 121 or a height of the two-dimensional barcode 122 may preferably be shorter than the length of the IJ print head 24 of the HHP 20.

Figure 27C:
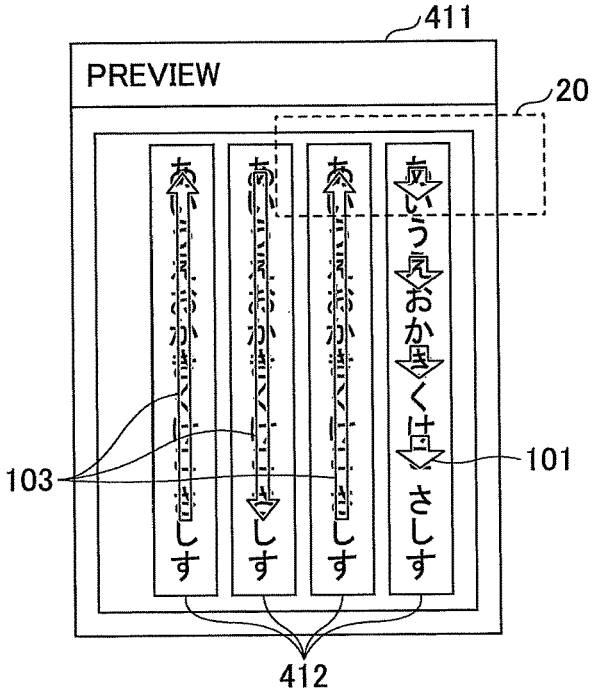

Also in the above embodiment, a case in which text written horizontally is printed has been described. However, text to be printed may be text written vertically. FIG. 27C is an example of a preview screen 411 of text written vertically. A user holds the HHP 20 such that a row of the nozzles 61 of the IJ print head 24 of the HHP 20 is in parallel with a width direction of the printing medium 12, and moves the HHP 20 in a vertical direction while keeping an angle of the HHP 20. In FIG. 27C, an arrow 101 indicating a scanning direction is displayed on a vertical scanning path 412. Also, background arrows 103 are displayed. Accordingly, in a case in which vertical written text is to be printed, the user can grasp the scanning direction easily.

<Displaying Scanning Direction by HHP>

Figure 28:
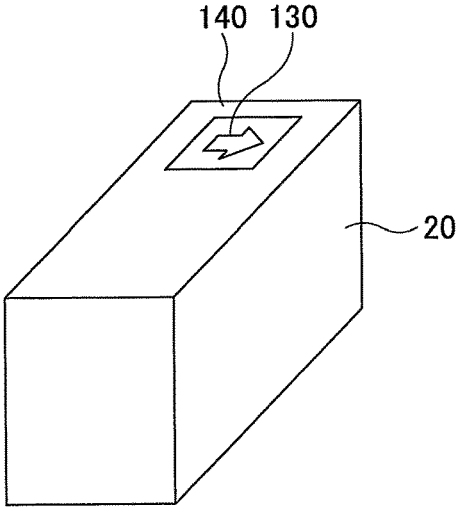
FIG. 28 is a diagram illustrating an example in which the HHP displays the scanning direction.

Not only the image data output device 11, but also the HHP 20 may display an arrow indicating a scanning direction. FIG. 28 is a diagram illustrating an example in which the HHP 20 displays a scanning direction. The HHP 20 illustrated in FIG. 28 is equipped with a display device 140 such as an LCD or an organic EL display. The HHP 20 determines a current scanning direction based on a scanning mode, and displays an arrow 130 indicating the scanning direction on the display device 140. Also, when a line feed is performed, an arrow indicating a line feed direction is displayed.

Accordingly, in a case in which a user moves the HHP 20 while looking at a printing medium 12, the user can recognize a scanning direction while minimizing an eye movement.

In addition, in a case in which the HHP 20 is moved in an incorrect direction, the HHP 20 may display an indication to this effect on the display device 140. Further, if the HHP 20 includes a vibrator, the HHP 20 may vibrate the vibrator in a case in which the HHP 20 is moved in an incorrect direction, to let a user know that a scanning direction is incorrect and to guide the HHP 20 in a correct scanning direction.

<Summary>

As described above, because the image data output device 11 according to the present embodiment displays a scanning direction that is necessary for printing an image, a user can grasp an appropriate scanning direction and move the HHP 20 in the appropriate scanning direction. Because occurrence of a case in which the HHP 20 is moved in an opposite direction is reduced, quality degradation of a printed image can be avoided.

<Other Examples>

A best mode for practicing the present invention has been described above using embodiments. However, the present invention is not limited to the above described embodiments. Various variations and replacements may be applied within the scope of the present invention.

For example, shapes of arrows 101 and 102, and a background arrow 103 illustrated in FIGS. 21A to 21C or the like are merely an example. Any types of figures may be used for indicating a scanning direction, as long as the figure to be used indicates a specific direction. For example, a simple triangle, or various figures including an arrow or a projection, may be used.

The image data output device 11 may also use voice to notify a user of a scanning direction. In this case, when a user presses the scan button 65, the image data output device 11 outputs a voice message such as "Move from left to right".

Further, in the present embodiment, cases in which text or a barcode is printed in a single scan have been described. However, when printing an image requiring multiple scans, the image data output device 11 can display a scanning direction. Even if quality of a printed image were to be degraded when printing an image requiring multiple scans, the degradation can be mitigated by other solutions. Although the image data output device 11 can display a scanning direction alone, the display function of a scanning direction may be implemented by the image data output device 11 and a server communicating with the image data output device 11. For example, the server may generate a preview screen.

Further, the image data output device 11 and a server may be used in accordance with the following scenario. Text entered by a user is sent to a server and recorded in the server associated with a user ID or the like. And then, the HHP 20 prints the text with the user ID. By executing the above process, a printed material of the user is associated with information in the server. This scenario can be used for home-visit care, a medication notebook, and the like.

Further, in a case in which a user inputs by voice text to be printed, the image data output device 11 and a server may be configured such that the image data output device 11 sends the voice data to the server and that the server performs voice recognition processing.

Further, in the examples of configurations illustrated in the diagrams of the above embodiment such as FIG. 6 or the like, functional blocks in accordance with major functions in the image data output device 11 are described, to facilitate understanding of the image data output device 11. However, the present invention is not limited to a type of division of units of process or to a name of each unit of process. Functional blocks in the image data output device 11 may be further divided into more units of process depending on types of processes. Alternatively, one functional block may be configured to include more processes than that described in the present embodiment.

The position calculation circuit 34 is an example of a position calculation means (or a position calculation unit), the controller 25 is an example of a droplet discharging means (or a droplet discharging unit), the preview generating unit 55 or the display device 140 is an example of a scanning direction output means (or a scanning direction output unit), and the operation receiving unit 53 is an example of a receiving means (or a receiving unit).

What is claimed is:

1. A non-transitory computer-readable recording medium storing a computer program to be executed by an information processing device communicating with an image forming device configured to form image data on a printing medium by being moved by a user on the printing medium, the image forming device including a position calculation unit for calculating a position of the image forming device, and an image forming unit for forming an image in accordance with the image data and location information, the computer program being configured:

to cause the information processing device to function as a scanning direction output unit for outputting a scanning direction of the image forming device, wherein the scanning direction output unit displays a preview image of the image data formed on the printing medium, and outputs the scanning direction by superimposing on the preview image.

2. The non-transitory computer-readable recording medium according to claim 1, the computer program further being configured to cause the information processing device to function as a receiving unit for receiving a setting related to the scanning direction, wherein the scanning direction output unit outputs the scanning direction based on the setting received by the receiving unit.

3. The non-transitory computer-readable recording medium according to claim 1, wherein the image data is generated by converting text data including at least one line, and the scanning direction output unit outputs the scanning direction by superimposing on the text data displayed as the preview image.

4. The non-transitory computer-readable recording medium according to claim 3, wherein the scanning direction output unit outputs the scanning direction for each scanning path, the scanning path being a part of the image data capable of being formed on the printing medium in a single scan of the image forming device.

5. The non-transitory computer-readable recording medium according to claim 4, wherein the scanning direction output unit determines a number of lines of the text data capable of being formed on the printing medium in the single scan of the image forming device, based on a specification of the image forming device, and determines the text data of the number of lines as the scanning path.

6. The non-transitory computer-readable recording medium according to claim 4, wherein the scanning direction output unit displays a first arrow indicating the scanning direction by superimposing on the scanning path which is being scanned by the image forming device, while moving the first arrow toward the scanning direction periodically.

7. The non-transitory computer-readable recording medium according to claim 4, wherein the scanning direction output unit displays a second arrow indicating the scanning direction on each of the scanning paths.

8. The non-transitory computer-readable recording medium according to claim 4, wherein the scanning direction output unit detects a completion of a scan of one of the scanning paths by a communication with the image forming device, and displays the one of the scanning paths in a different style from another scanning path not having been scanned.

9. The non-transitory computer-readable recording medium according to claim 4, wherein the scanning direction output unit detects a completion of a scan of one of the scanning paths by a communication with the image forming device, and in a case in which at least one scanning path has not been scanned, displays a line feed direction between a current scanning path which has been scanned most recently and a scanning path next to the current scanning path.

10. The non-transitory computer-readable recording medium according to claim 6, wherein the computer program is further configured to cause the information processing device to acquire, with respect to a current scanning path which is being scanned, information concerning to what extent the current scanning path has been formed on the printing medium by the image forming device, and the scanning direction output unit displays the first arrow on a part of the current scanning path which has not been formed on the printing medium.

11. The non-transitory computer-readable recording medium according to claim 10, wherein the scanning direction output unit displays a part of the current scanning path which has been formed on the printing medium and a remainder of the current scanning path, which is the part of the current scanning path which has not been formed on the printing medium, in different styles.

12. The non-transitory computer-readable recording medium according to claim 10, wherein the scanning direction output unit, in a case in which a scanning direction of the current scanning path, estimated based on the information concerning to what extent the current scanning path has been formed on the printing medium, is different from a scanning direction set to the current scanning path, displays information indicating that the image forming device is moved toward a different direction.

13. The non-transitory computer-readable recording medium according to claim 10, wherein the computer program is further configured to cause the information processing device to acquire the location information as the information concerning to what extent the current scanning path has been formed on the printing medium, and the scanning direction output unit displays an amount of movement of the image forming device in a line feed direction required for moving the image forming device to a scanning path next to the current scanning path, based on the location information.

14. An image forming device configured to form image data on a printing medium by being moved by a user on the printing medium, the image forming device comprising:

a position calculation unit for calculating a position of the image forming device, an image forming unit for discharging a droplet forming an image in accordance with the image data and location information, and a scanning direction output unit for outputting a scanning direction of the image forming device, wherein the scanning direction output unit displays a preview image of the image data formed on the printing medium, and outputs the scanning direction superimposing on the preview image.

15. An image forming system comprising:

an image forming device configured to form image data on a printing medium by being moved by a user on the printing medium, the image forming device including a position calculation unit for calculating a position of the image forming device, and an image forming unit for forming an image in accordance with the image data and location information; and a computer program for causing an information processing device communicating with the image forming device to function as a scanning direction output unit for outputting a scanning direction of the image forming device, wherein the scanning direction output unit displays a preview image of the image data formed on the printing medium, and outputs the scanning direction by superimposing on the preview image.

* * * * *